US011358405B2

(12) United States Patent
Naunton et al.

(10) Patent No.: US 11,358,405 B2
(45) Date of Patent: Jun. 14, 2022

(54) DROPLET DEPOSITION HEAD ALIGNMENT SYSTEM

(71) Applicant: Xaar Technology Limited, Cambridge (GB)

(72) Inventors: Ulrik Manfred Naunton, Cambridge (GB); Stephen Mark Jeapes, Cambridge (GB); Richard Hugh Lewis, Cambridge (GB); Jesus Garcia Maza, Cambridge (GB); Arturo Garcia Gomez, Cambridge (GB); Robert John Charles Dunn, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 39 days.

(21) Appl. No.: 16/901,609

(22) Filed: Jun. 15, 2020

(65) Prior Publication Data

US 2020/0369054 A1 Nov. 26, 2020

Related U.S. Application Data

(62) Division of application No. 16/094,419, filed as application No. PCT/GB2017/051037 on Apr. 13, 2017, now Pat. No. 10,682,873.

(30) Foreign Application Priority Data

Apr. 18, 2016 (GB) ..... 1606738

(51) Int. Cl.
*B41J 25/34* (2006.01)
*B41J 25/00* (2006.01)
(Continued)

(52) U.S. Cl.
CPC ..... *B41J 25/34* (2013.01); *B41J 2/04505* (2013.01); *B41J 2/04586* (2013.01);
(Continued)

(58) Field of Classification Search
CPC ..... B41J 25/34
See application file for complete search history.

(56) References Cited

U.S. PATENT DOCUMENTS 4,080,607 A 3/1978 Van Breemen et al.
6,161,920 A 12/2000 Santhanam et al.
(Continued)

FOREIGN PATENT DOCUMENTS

CN 1423595 6/2003
CN 1984780 9/2010
(Continued)

OTHER PUBLICATIONS

Chinese First Office Action, in corresponding Chinese Application No. 201780024164.X, (6 pages), and machine translation (5 pages).
(Continued)

*Primary Examiner* — Sharon Polk
(74) *Attorney, Agent, or Firm* — Finnegan, Henderson, Farabow, Garrett & Dunner LLP

(57) ABSTRACT

A droplet deposition head including a datum surface arrangement for alignment of the head relative to an external mounting component in either a vertical mounting mode in which the head is held against a vertical mounting plate or a horizontal mounting mode where the head is held against a horizontal mounting plate. The datum surface arrangement comprising at least seven datum surfaces (x1; y1, y2, y3; z1, z2, z3) provided on the head, wherein five of the seven datum surfaces are provided for alignment in both vertical and horizontal mounting modes, and wherein a sixth datum surface (z3) is provided for alignment exclusively in said horizontal mounting mode and a seventh datum surface (y3) is provided for alignment exclusively in said vertical mounting mode.

17 Claims, 15 Drawing Sheets

(51) Int. Cl.
*B41J 25/308* (2006.01)
*B41J 2/21* (2006.01)
*B41J 2/045* (2006.01)

(52) U.S. Cl.
CPC ..... *B41J 2/2146* (2013.01); *B41J 25/001* (2013.01); *B41J 25/3086* (2013.01)

(56) References Cited

U.S. PATENT DOCUMENTS

| | | | | |
|---|---|---|---|---|
| 6,428,141 | B1 * | 8/2002 | Mc Elfresh | B41J 2/14024 347/13 |
| 6,554,397 | B1 | 4/2003 | Williams | |
| 6,692,102 | B2 | 2/2004 | Hendricks | |
| 6,789,881 | B2 | 9/2004 | Silverbrook | |
| 6,796,630 | B2 * | 9/2004 | Ison | B41J 2/14209 347/18 |
| 7,701,478 | B2 | 4/2010 | Murcia et al. | |
| 8,226,215 | B2 | 7/2012 | Bechler et al. | |
| 8,297,736 | B2 | 10/2012 | Gouch et al. | |
| 8,454,128 | B2 | 6/2013 | Fishkin et al. | |
| 9,440,442 | B2 | 9/2016 | Sheffelin et al. | |
| 2002/0015608 | A1 | 2/2002 | Williams et al. | |
| 2005/0243127 | A1 * | 11/2005 | Higginson | B41J 2/145 347/40 |
| 2005/0280678 | A1 | 12/2005 | Bibi et al. | |
| 2008/0170089 | A1 | 7/2008 | Albertalli et al. | |
| 2008/0211872 | A1 * | 9/2008 | Hoisington | B41J 2/155 347/49 |
| 2011/0001780 | A1 | 1/2011 | Amidon, Jr. et al. | |
| 2014/0292923 | A1 | 10/2014 | Owaki et al. | |

FOREIGN PATENT DOCUMENTS

| | | | |
|---|---|---|---|
| CN | 101774299 | | 5/2011 |
| CN | 1997521 | | 11/2011 |
| CN | 104066588 | | 9/2014 |
| CN | 102971151 | | 2/2015 |
| CN | 103381705 | | 8/2016 |
| EP | 1748895 | A1 | 2/2007 |
| EP | 1854635 | A1 | 11/2007 |
| WO | WO2013/112168 | A1 | 8/2013 |

OTHER PUBLICATIONS

International Search Report and Written Opinion dated Sep. 5, 2017, in corresponding International Application No. PCT/GB2017/051037 (14 pages).

* cited by examiner

DROPLET DEPOSITION HEAD ALIGNMENT SYSTEM

This application is a divisional of U.S. application Ser. No. 16/094,419, filed Oct. 17, 2018 (currently pending), which is a National Stage Entry of International Application No. PCT/GB2017/051037, filed Apr. 13, 2017, which is based on and claims the benefit of foreign priority under 35 U.S.C. § 119 to GB Application No. 1606738.1, filed Apr. 18, 2016. The entire contents of the above-referenced applications are expressly incorporated herein by reference.

The present disclosed embodiments to a droplet deposition head. It may find particularly beneficial application in printing devices, such as inkjet printheads.

Typical printer architectures for scanning and single-pass are different. The former uses a carriage travelling over the print medium while the latter uses a fixed beam or printbar above the medium. For scanning applications using a carriage, the most typical structural element holding one or more printheads is a horizontal plate on top of which the heads are assembled, with apertures in the plate to hold the heads. For single-pass applications, the most typical structural element holding the printheads is a vertical plate or printbar, and the printheads are held against a side of it.

Most printheads in the market today are designed to be installed in a particular printer configuration such that they are not easy to install in another configuration without requiring significant adjustment of the alignment between the nozzle array and the receiving print medium.

Aspects of the disclosed embodiments are set out in the appended claims to a droplet deposition head, such as a printhead, to devices for mounting the printhead, and to an assembled system comprising the printhead, and to corresponding
methods for manufacturing and for installing/assembling.

A printhead is typically of a generally cuboid, or composite cuboid, shape, comprising a base at its lower end that holds the components within which the pressure chambers with nozzles (actuators) are located, and a cover that is used to close off from the environment any fluidic, electronic or other components arranged on top of the base. It should be understood that the disclosed embodiments as will now be described are not limited to a printhead being of a cuboid shape. In principle, datum planes for alignment to a mounting component may be defined by suitable datum surfaces for any shape of head. The datum planes may be described as part of an orthogonal axis system or any other suitable system, and a Cartesian coordinate system may be as suitable as other systems may be, such as polar or spherical coordinate systems etc. Further, the mounting plates need not be oriented "horizontally" or "vertically"; they might equally be arranged at an angle to the vertical and/or horizontal. Further still, the arrangement of the mounting components within the printer may be such that the nozzles face in another direction that directly downwards, for example the nozzles may be arranged to print onto shaped articles so that the nozzle plate is inclined with respect to the horizontal.

The printhead, like any solid body, has six degrees of freedom to move, and for the purposes of illustration, referring to a Cartesian, orthogonal system, it will have translational motion along the x, y and z-axes, by which axes the printhead shape may also be described, and rotational movement about each of the three axes. To securely mount and reference a printhead against a mounting component, six reference points or small surfaces are required, one to fix it against each degree of freedom of movement.

In the plate-mounted configuration for a scanning mode application, the printhead will need to be referenced against six corresponding small and sufficiently well-defined surfaces within, or associated with, an aperture in a horizontal plate. These surfaces are generally termed datum points or simply datums.

A primary datum plane is generated by three small datum surfaces defining the plane of the printhead that will face the primary surface of the mounting plate and secure the printhead in the vertical (z) direction. For the plate-mounted configuration, this is the x-y plane of the printhead. A secondary datum plane (in this configuration the z-x plane) perpendicular to the primary plane is defined by two further small datum surfaces near the two longitudinal ends of the base that specify the intersection of the secondary datum plane with the primary datum plane (also the x-axis of the printhead). A tertiary, or z-y, datum plane perpendicular to both primary and secondary datum planes is defined by one small datum surface. In this way, six datums define the orientation of the printhead in an x-y-z coordinate system. It will be appreciated that a similar approach might be used to define the printhead orientation in a non-orthogonal axis system, where some of the angles between the planes may not be 90°. In this case, the two datum surfaces y1, y2 define the intersection of the primary plane with a secondary datum plane, and the x1 datum surface defines the location of the primary datum plane along said intersection.

A repeatability of 10 μm is desirable when installing/replacing a printhead. In the case of the mounting plate, it is preferred to locate the datum surfaces near the lower portion of the printhead to avoid introducing either rotational moments of forces applies to urge the datum surfaces against corresponding receiving surfaces in the base, or having to build up the plate to provide corresponding reference surfaces higher up the head. Therefore, in this configuration, all datum points are preferably located in the base, or frame, of the printhead.

Such a base typically holds the printhead actuators. The array of actuator elements, each element typically containing one nozzle for ejecting ink, may be made by different techniques well known in the art. For example, the array may be manufactured from a piezoelectric 'bulk' wafer into which parallel longitudinal grooves are sawn. These grooves are to form ink channels by closing off one of the open surfaces with a nozzle plate while the other open surfaces are used to supply ink to the nozzle. Another example is an array made by silicon MEMS technology. Typically this technology uses manufacturing techniques that allow an effective way of producing multiple, accurately aligned nozzle arrays within the same silicon part, however the parts are fragile and yield decreases the bigger they are. Therefore, typically several silicon parts are used within the same printhead. These arrays require to be matched to appear as one continuous row of nozzles on the print medium. This can be achieved by arranging the silicon parts such that nozzle arrays from different silicon parts partially overlap in their end regions, and suitable nozzles from each array can be chosen in the overlap region to achieve a required image quality. The same approach might be used to arrange several arrays made from a piezoelectric bulk wafer within the same printhead.

In a low-resolution printhead, fine tuning of the alignment may be possible by mechanical means. However, for a high-resolution printhead a mechanical fine align is no longer practical and is typically addressed through software by altering the properties of the ejected droplets. This may be achieved by adjusting for landing errors by changing the velocity of the ejected droplets, brought about by altering the drive signal that deforms the piezoelectric element.

For any type of printhead it is preferable to achieve robust alignment of the actuating components within the printhead with respect to a reference plane during assembly of the head. If such a reference plane at point of assembly could be re-used when the printhead is installed in the printer, both initial installation and replacement of a printhead would be made much easier and quicker, and an entirely new alignment system would not be needed.

All datum surfaces may be in the form of raised lands or protrusions, preferably made in a single part, constituting or including the printhead base, having a small coefficient of thermal expansion to ensure alignment is maintained during use of the printhead which might expose the base to thermal cycling. Such thermal cycling might otherwise cause a shift in datum surfaces and/or impart stress on the actuator parts it supports. Such a base may therefore be made of a ceramic or of stainless steel, for example. The datum surfaces will generally be formed during the manufacture of the printhead, so every important feature in the printhead is naturally accurately positioned against them.

In the single-pass mounting system, the printhead may be fixed to a vertical mounting plate, also called a printbar. While it is in principle possible to design a corresponding mount to receive the same six reference datums as for the plate mount, this would require mounting the heads on a shelf located on the printbar having similar receiving surfaces as the plate for the scanning mode. It is however desirable to mount several printbars closely together to be able to manage for example variations in the speed of, or distance of the actuator arrays to, the receiving medium, and such a shelf would increase the distance between printbars. Instead, it is preferable to use the rear surface of the printhead as the primary alignment plane so that it can be secured against a vertical surface of the printbar. This then requires a principal plane to be defined by three datum surfaces on the rear of the printhead, where the two datums at either end of the base can be re-used from the previously described plate mounting system, and an additional datum surface located near the top of the rear surface of the printhead presents the third datum surface. A primary datum plane is therefore again generated by three small datum surfaces, a secondary datum plane perpendicular to the primary datum plane is defined by two small datum surfaces and a tertiary datum plane perpendicular to the primary and secondary datum planes is defined by one small datum surface. This mounting system uses the same five small datum surfaces of the six small datum surfaces used in the scanning mounting system, and introduces one new small datum surface near the top rear of the printhead.

The two mounting systems share five of the seven datum surfaces located on the printhead. The mounting-to-printbar scheme replaces the datum in the lower front of the printhead by one near the top rear surface of the printhead. Typically such a top datum is located in a different structural part of the printhead, such as the cover, which may be manufactured separately. The mechanical accuracy of this arrangement may be limited, but this can be compensated for, as will be described below.

The disclosed embodiments are also concerned with devices required to hold, or fix, the printhead securely and reproducibly in a printer, in either the single-pass mode or the scanning mode. Such devices may themselves apply the forces acting against the datum surfaces, or allow them to be applied. They should be as compact as possible to allow printheads to be placed adjacent to each other as closely as possible.

In some embodiments of the proposed mounting system, the different forces required to urge the datums against the receiving parts within the mounting system or mounting component are provided by two or more parts. First, vertical extending supports, or "dividers", are placed between the heads in the x-direction. These provide datum-receiving surfaces and carry force-exerting components such as springs to provide at least some of the horizontal (x-y) forces required to secure the head to the vertical mounting plate (e.g. printbar) or to the horizontal mounting plate. These dividers may be the same component or, more usually, different components for the two mounting systems. Secondly there will be a device such as a lever, mounted for convenience on the top of the divider, which may carry a spring that provides a force to urge the top datum against the vertical plate, or to urge the datum in the base front to the horizontal mounting plate. The lever may be hinged at one end so that it can be moved out of the way during head removal or installation. For increased leverage, a jacking screw may be incorporated, pulling the lever down into the correct position relative to the dividers and in so doing compressing the spring sufficiently to give the required force; however, other means may equally be applicable.

In principle therefore, the same fixing concept can be used for scanning and static installations, using either a horizontal mounting plate or a vertical mounting plate. It may be advantageous to incorporate a different angle of the spring-loaded plunger or lever for each case, in particular to incorporate a slight y-component for the vertical plate-mounted configuration.

Mounting heads very closely together contributes to increased resolution and better printed image quality. To this end the mounting mechanism is preferably enclosed within the space envelope of the head, which will have been determined by other factors. That is, the lever applying a force in the z-direction is within the x-y surface outline, and the dividers applying x- and y-forces are enclosed within the y-z surface outline, or at least in they-direction. Head-to-head spacing in a printer is therefore dictated by the head geometry and not by features of the supports and mounting devices; consequently the heads can be very closely mounted.

A significant development of the mounting system is that, during printhead assembly, the base part of the printhead may be held in place using the horizontal plate mounting system. Using an alignment process during placement and bonding of the actuator components within the frame, it can be ensured that the plane in which the nozzles are located, typically the nozzle plate, is fixed so that its plane-perpendicular is parallel to that of the primary plane defined by the three datum-receiving surfaces in the mounting plate for the z-datum surfaces in the base. This may for example be done by optical alignment against fiducial points etched into the nozzle plate, or using the nozzles themselves as fiducials, as is known. In this way, any variation between the z-datums in different base parts is corrected with respect to the horizontal mounting plate used during assembly.

Upon full assembly of the printhead, and again using the horizontal plate mounting system, a calibration pattern may be printed that determines any deviations between nozzles. From these, calibration values may be calculated and recorded for use during operation after installation into a printer by, for example, storing the calibration values in a non-volatile memory within the printhead.

When the thus assembled printhead is subsequently secured to the vertical mounting plate mount system, the main change in alignment may be introduced by the top reference datum, causing a rotation in the frame about its longitudinal axis (here referred to as x-axis, or the direction of the array). This in turn would introduce a landing error (in this text also referred to as Theta-x) on the print medium by causing droplets to be ejected at an angle with respect to the print medium, and thus taking either more or less time to travel from the nozzle to the print medium depending on whether the tilt is introduced in the forward or backward direction of the head. Landing errors due to travel time may be corrected by adjusting the droplet velocity, and correction values may be stored in a non-volatile memory that may be part of the printhead. The necessary correction values can therefore be incorporated at manufacture, and applied after print tests once the printhead is mounted on the vertical mounting plate mounting system.

Therefore, a pre-calibration can be carried out at manufacture, before the printhead is installed in the printer. If at installation into a printer the datum-receiving surfaces used correspond to those defined for the described mounting system on the printhead, only a small further adjustment needs to be made, for example through software using a similar approach as is used during assembly, to adjust for any minor differences in manufacture between the mounting system used during assembly and the mounting system used for installation.

It will be apparent that, by using the same mounting system during assembly as is intended for installation, the absolute or specific height of the datum surfaces is not important and therefore it is not necessary to use materials that allow precision machining. Instead, an injection-moulded material may be used for the frame. This process is highly cost-effective but typically causes around 20% of shrinkage in the frame, and therefore a set of datums not relying on accurate dimensions is preferred. By using the simple geometrical relationship between the two datum systems, and by recording calibration factors for each in the non-volatile memory in the printhead so that they may be used once installed in the printer with the user only required to apply fine tuning through software (or any mechanical calibration if it were appropriate or suitable for the given printhead properties such as its resolution), manufacture and installation is made easier and cheaper.

The system here described is conceived for use with droplet deposition devices. These include inkjet printers, but a variety of alternative fluids in a variety of applications may be deposited by a droplet deposition head. For instance, a droplet deposition head may eject droplets of ink that may travel to a sheet of paper or card, or to other receiving media, such as ceramic tiles or shaped articles (e.g. cans, bottles etc.), to form an image as is the case in inkjet printing applications (where the droplet deposition head may be an inkjet printhead or, more particularly, a drop-on-demand inkjet printhead).

Alternatively, droplets of fluid may be used to build structures; for example, electrically active fluids may be deposited onto receiving media such as a circuit board so as to enable prototyping of electrical devices.

In another example, polymer-containing fluids or molten polymer may be deposited in successive layers so as to produce an object (as in 3D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the input data provided to the head.

BRIEF DESCRIPTION OF THE DRAWINGS

For a better understanding of the disclosed embodiments, the embodiments will now be described with reference to the attached drawings, in which.

DETAILED DESCRIPTION

The following disclosure describes a droplet deposition head comprising a datum surface arrangement for alignment of the droplet deposition head relative to a receiving component external to the droplet deposition head; the datum surface arrangement comprising at least seven datum surfaces arranged on the body of the droplet deposition head, wherein five of the seven datum points are shared for positioning of the droplet deposition head in both a horizontal and a vertical mounting system or mode, a sixth datum surface being selected for each mode from the two remaining datum surfaces. Also described are corresponding systems of dividers for securing such heads to a support external to the head, a divider including a main body, fastening means for fixing the main body to the support, and at least two biasing means, or a double-action biasing means, arranged on the divider system so as to provide force on the droplet deposition head along two axes against predefined references on the support; and droplet deposition systems including one or more heads and two or more dividers.

The disclosure additionally describes methods of mounting such printheads and other droplet deposition devices on supports for different operating conditions, and methods of manufacturing such droplet deposition heads with their alignment fixed with reference to the support, in particular to a mounting plate.

Figure 1:
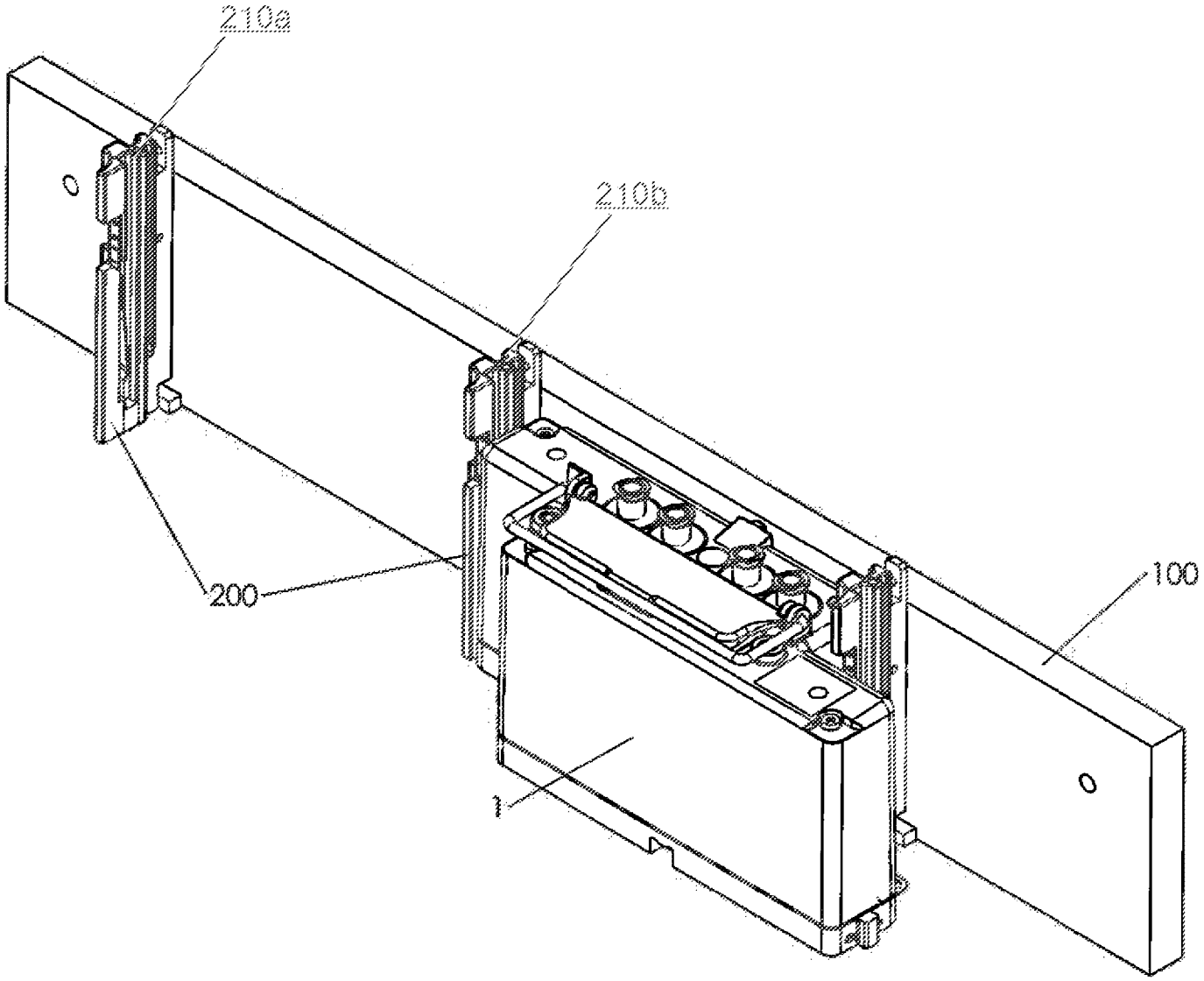
FIG. 1 shows a vertical mounting plate used for mounting printheads in a single-pass or static system.

FIG. 1 shows a vertical mounting plate 100 on which printheads 1 are to be mounted for a single-pass printer, i.e. the vertical mounting plate and printheads remain static and the print medium passes under the printheads in they-direction in a single pass. One such printhead is shown, but several would normally be mounted adjacent to each other along the extent of the bar (x-direction) so as to cover the width of the print medium. For increased resolution or to provide multiple colour inks there may be two or more such vertical mounting plates mounted closely behind one another. Each printhead may be held in position in the horizontal (x-y) plane by a suitable arrangement of resilient devices, such as springs, fitted to a system of dividers 200, in this example shown as one divider at each end of each printhead, to be described. The printhead is held in position in the vertical (z) direction by a suitable clamp, not shown here.

Figure 2A:
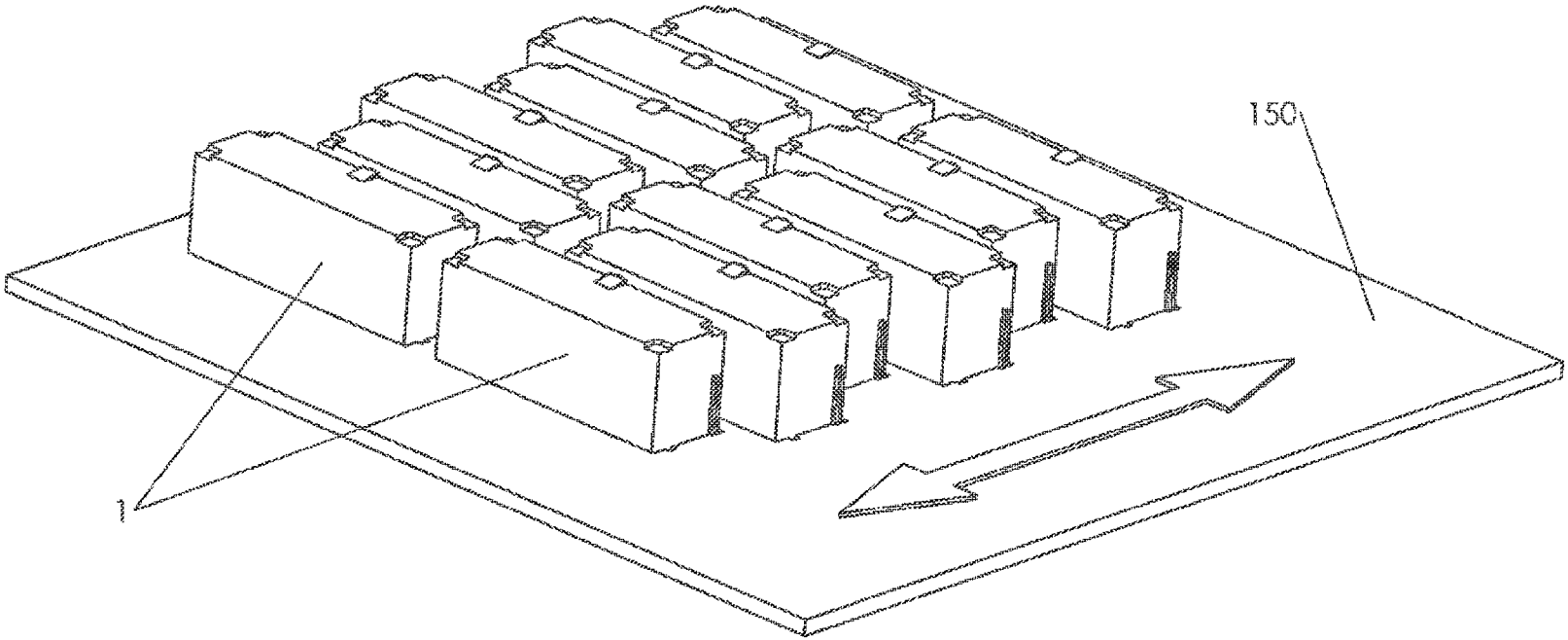
FIG. 2A shows a plate with cuboid-shaped printheads mounted on a horizontal mounting plate used for mounting e.g. in a scanning system.

FIG. 2*a* shows a plate 150 on which cuboidal printheads 1 are mounted for a scanning printer, i.e. one where the medium is, or may be, fixed and the printheads pass back and forth over the medium as required to print the image. In other applications such as 3D printing the printheads may move in other directions also, e.g. in a direction perpendicular as well as opposed to the first. Here six rows of printheads are shown, two in each row, but this is purely by way of example. This drawing does not show the dividers between the printhead, holding the heads in a precise location and orientation on the plate, or any clamps to secure them—these will be described later—nor does it show the various connections to the printheads, the latter being no concern of the disclosed embodiments.

Figure 2B:
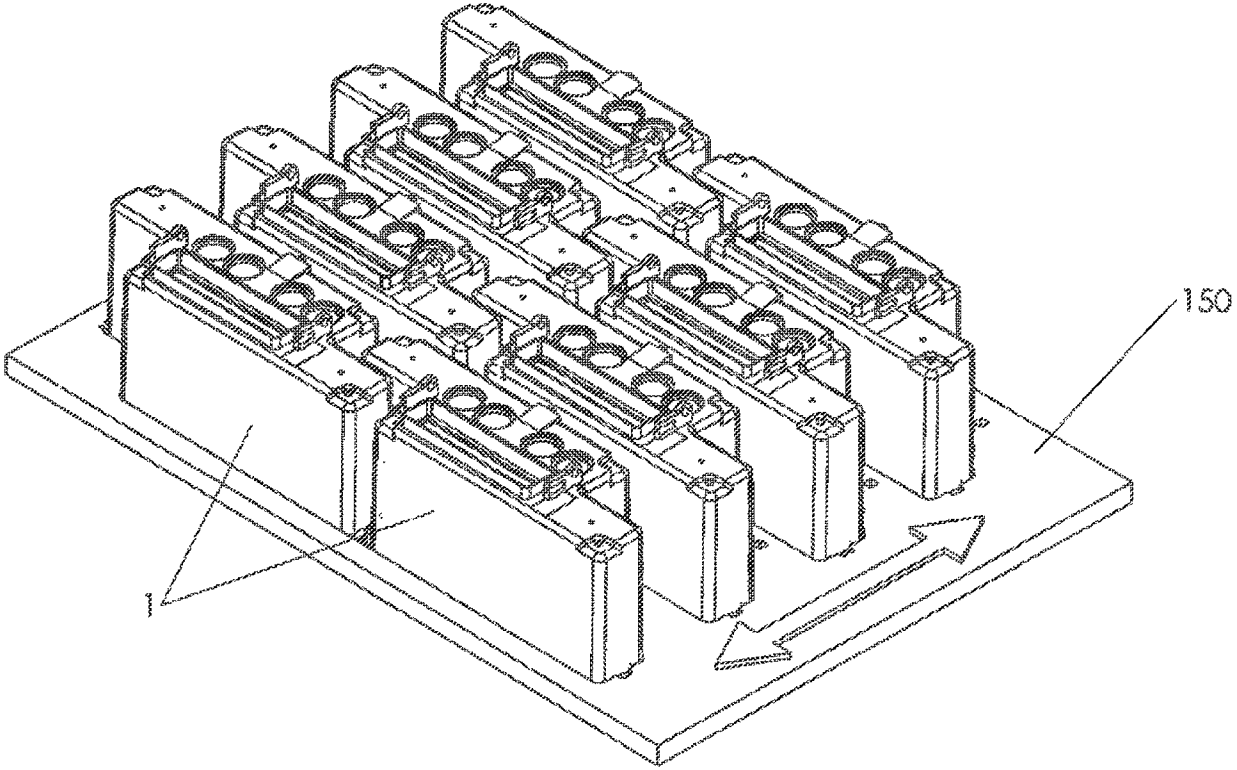
FIG. 2B shows complex-shaped printheads mounted on a horizontal mounting plate.

FIG. 2*b* shows a similar view, again without the dividers, of an assembly of printheads of a variant type, mounted in a corresponding plate 150, the same reference numeral being used for brevity. Here the printheads are, like those of FIG. 1, of a complex or composite cuboidal shape, of two simple cuboids fitted together over their largest face, with an offset in one direction (the x-direction). This design typically results from multiple actuator arrays located within the same printhead and requiring overlap in nozzle apertures in the x-direction.

Figure 2C:
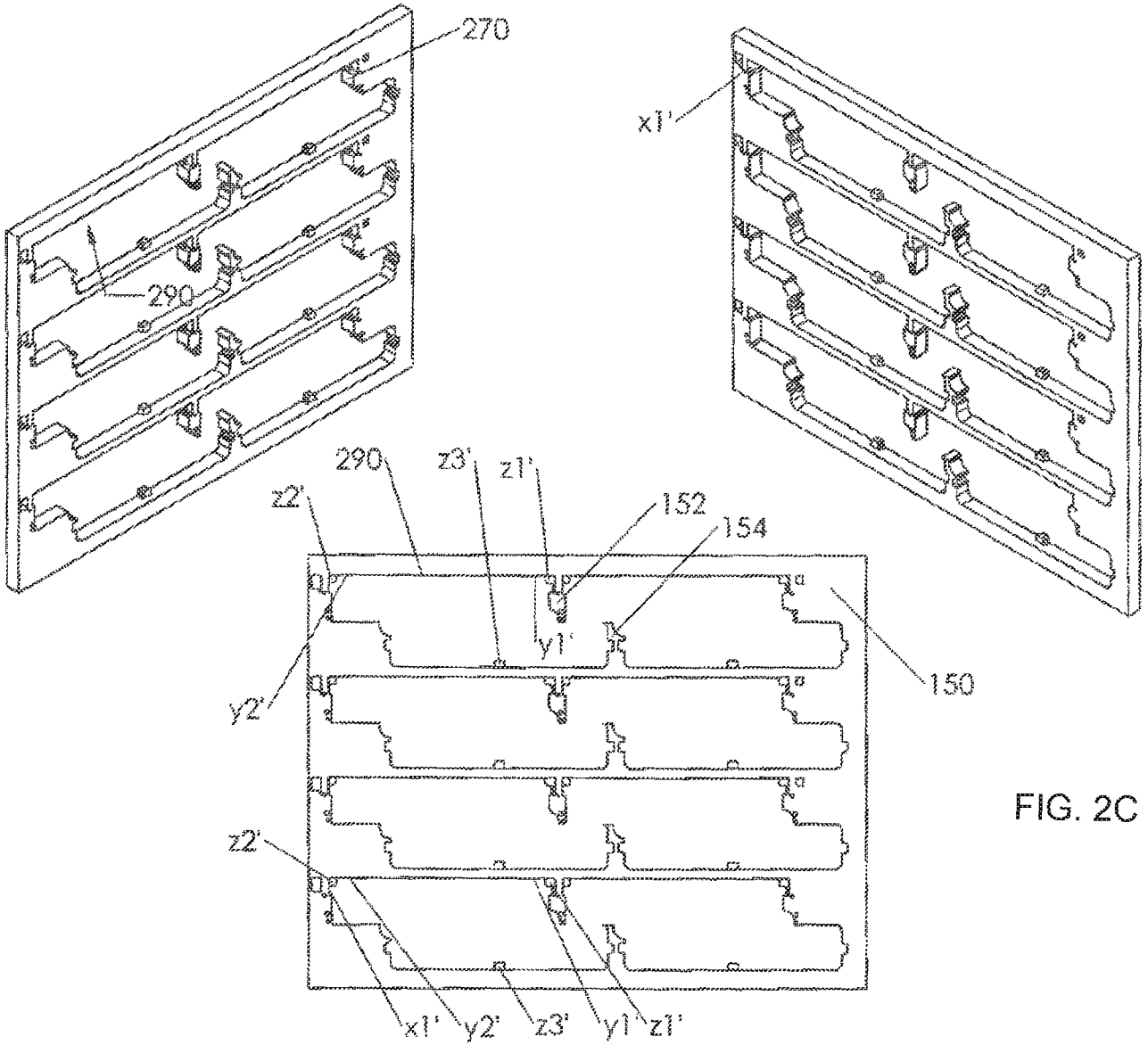
FIG. 2C shows views of the horizontal mounting plate with its various reference surfaces.

FIG. 2*c* shows the plate 150 of FIG. 2*b* from various angles. It can be seen that, within each aperture for a complex shaped printhead, there are small projecting lands z1'-z3', sunken with respect to the main surface of the plate 150. The printhead rests on these lands, as will be explained. It also abuts with the rear of its base via two datums y1, y2 (shown in FIG. 3*b*) against the surface 290 on the z1'-z2' side of the aperture.

Each printhead has to be aligned as accurately—that is to say, repeatably—as possible in the respective mount (vertical or horizontal mounting plate, with their respective fitting components) so that only very slight adjustments need to be made to the printed image via adjustment of the properties of the ejected droplets by the drive control of the printhead. To this end the mount itself and the printhead have corresponding pairs of alignment or reference points known as datum points or datum surfaces, or just "datums", which abut against each other so that the printhead is in a well-defined position. Once mounted, the alignment is then fine-tuned, typically electronically, by making suitable adjustments to the droplet ejection properties to correct for any droplet landing misplacements.

Figure 3A:
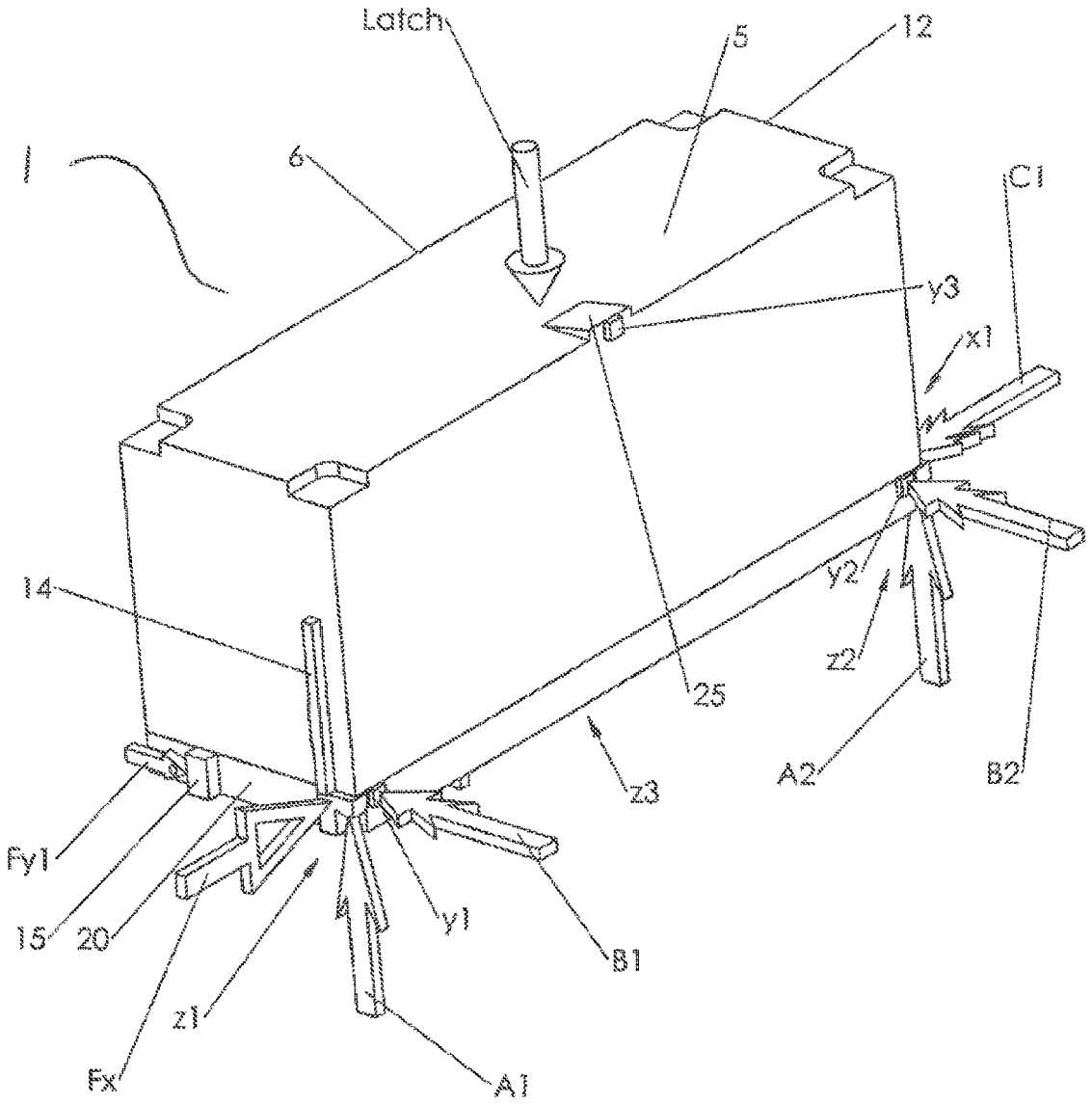
FIG. 3A shows a cuboid-shaped printhead in accordance with the disclosed embodiments, with the reference points and directions of force required indicated for scanning mode

Hitherto, printheads have been designed, with their datum points, for exclusive use in one mounting configuration and not the other. FIG. 3*a* shows a simple cuboid printhead as presently proposed, which can be used interchangeably in either system. Its shape corresponds to that shown in FIG. 2*a*. Since the salient points are the same, further discussion centres around the complex cuboid shaped version as shown in FIG. 2*b*.

Figure 3B:
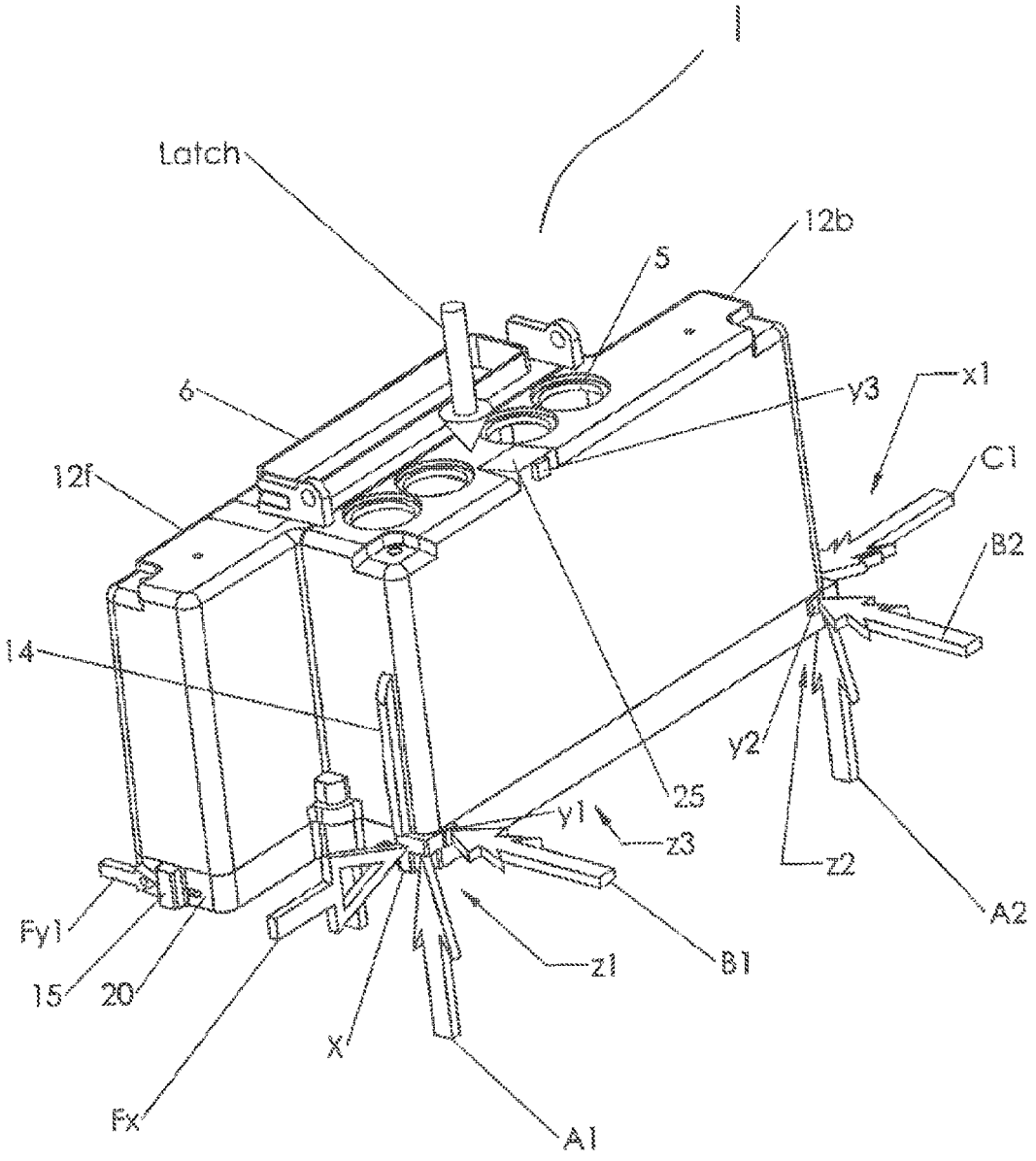
FIG. 3B shows a complex-shaped printhead in accordance with the disclosed embodiments, with the reference points and directions of force required indicated for scanning mode.
Figure 3C:
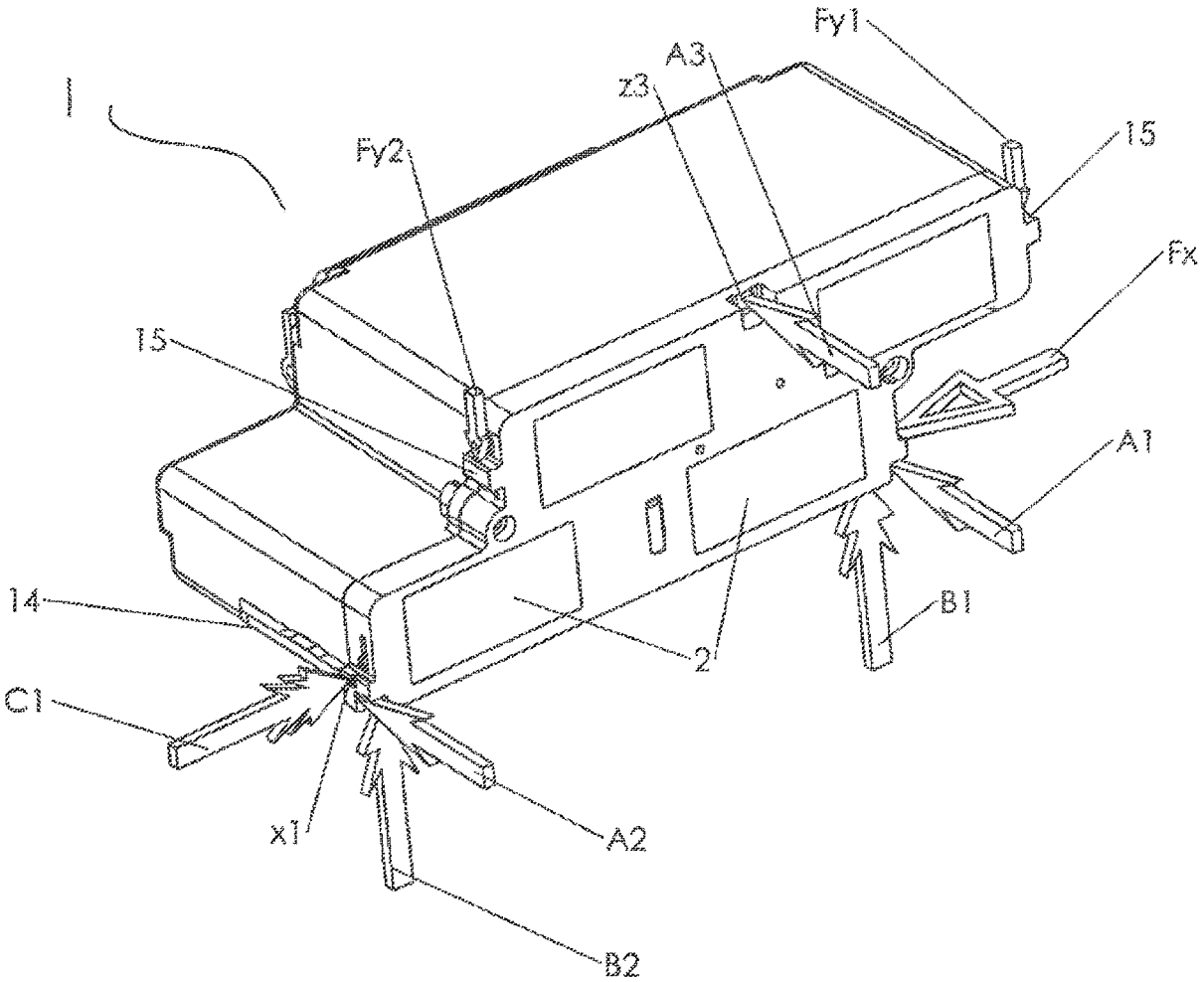
FIG. 3C shows a view from underneath of the complex-shaped printhead of FIG. 3B.

FIGS. 3*b* and 3*c* show two perspective views of an implementation of the seven datum surfaces in the complex cuboid head. In such a complex cuboid printhead, two or more rows or actuator components 2 will each comprise one or more nozzle arrays. The two or more rows (here, two are shown) may be offset from one another in the x-direction to allow for correcting array edge effects between arrays during image printing. This problem and solutions to it are well known in the art. This arrangement of actuator components 2 results in a 'complex' cuboid shaped printhead. Other shapes are also possible depending on the shape and arrangement of the actuator components 2, but this should not affect the concept of the mounting system and its associated datums described herein.

Like numerals represent like features as for FIG. 3*a*. A printhead 1 as shown has a cover 12 generally consisting of two cuboidal blocks, offset in the longitudinal (x) direction, which during use in a vertical mounting plate application is perpendicular to the direction of travel of the receiving (print) medium. The two blocks are labelled 12*f* and 12*b*, front and back in the direction of travel of the medium (y-direction). However, the two blocks are not usually physically separate. The offset-block shape further allows printheads to be mounted end-to-end in such a way that the end portions of the nozzle arrays in each head overlap in the x-direction with the end portions of the nozzle arrays in the next head.

The cover 12 may be made of a plastic material. In this example it is coupled to a base 20, of identical footprint, made from a material that can ensure reliable definition of the datum surfaces it contains. Most importantly it is required to remain stable without dimension change during operation within the printer, for example having a low thermal coefficient when being exposed to environmental changes, or to heat dissipated within the printhead or introduced via the vertical mounting plate; it should also be of stiffness adequate to prevent deformation under forces acting upon it when secured to the either mounting plate, and to prevent deformation of its integral datum surfaces when pressing against the corresponding surfaces on the respective mounting plate. In addition, it is generally desirable that the frame is a good match in its thermal coefficient of expansion to the actuator elements to avoid introducing thermal stresses into the actuator. Ceramics or stainless steel are commonly used.

The printhead 1 is provided with a number of datum points used to align the printhead during mounting. Since for a solid body there are six degrees of freedom of movement, six such points are needed for any given mounting procedure. Physically the datum points can be features taking the form of small lands or protrusions, or recesses, at predefined points on the exterior of the printhead. These features will generally align by abutment in the x, y or z direction against corresponding features in the mount (e.g. vertical or horizontal mounting plate), though theoretically some other, perhaps optical, alignment can be envisaged.

For mounting on a plate 150, these six points may all be integral to the base 20 of the printhead, because this is the part that will be in contact with the mounting plate 150. Each cuboid block carries at least one row of actuator-containing elements 2. The datums are designated by letters x, y and z as will be described. Six of the datums are visible in FIGS. 3*a* and 3*b*, relevant to the scanning mode. To define the horizontal, or x-y plane, of the printhead, three datums z1, z2 and (indicated by an arrow pointing to the underside of the front section 12*f* of the printhead, and visible in FIG. 3*c*) z3 are located in the base 20 with their surfaces perpendicular to the z-direction; that is, in this embodiment small surfaces are formed that are generally parallel to the x-y plane of the printhead. Then, to define the specific location of this plane laterally within the horizontal mounting plate, two datum surfaces y1 and y2 are formed at the rear of the base 20, one at each end, and in this embodiment in the vicinity of the first two datum surfaces z1 and z2 but with their plane surfaces perpendicular to they-direction (i.e. extending in the x-z direction). These two datums define the location of the secondary, or z-x, plane (perpendicular to the x-y plane) of the printhead within the horizontal mounting plate. Finally a single datum surface x1, shown in FIG. 3*c* and indicated in FIG. 3*b*, is formed on the base 20 along a surface extending in the y-z-direction, preferably located towards or near the rear of the printhead and shown here near the two datum surfaces z2 and y2. The x-datum defines the location of the y-z plane of the printhead with respect to the mounting plate. Preferably, the z1,2 and the y1,2 datum surfaces are located near the outer edges of the rear of the base at opposing ends such that they are separated from one another as much as possible to minimise the margin of error when transferring the printhead from one mounting plate (or mounting arrangement) to another.

Here "small" indicates size in comparison to the dimensions of the printhead, thus approximating to a point; a linear figure of 1-5% may be appropriate. The surfaces may be flat; or they may be domed with a large radius of curvature.

The datums z1-z3 of the printhead align with their opposite numbers z1'-z3' on the mounting plate 150 shown in FIG. 2*c*; the datums x and y abut against datum-receiving surfaces on the plate or on the dividers, to be described, or on both; however, preferably they locate against datum-receiving surfaces on the plate as shown by datum-receiving surfaces y1', y2' and x' in FIG. 2*c* in order to avoid introducing rotational components of force that may be introduced when the force is applied offset from the location of the datum and its receiving surface.

The datum-receiving surfaces z1'-z3' define the primary plane A in the scanning-mode system. The force applied to urge the z-datums against the receiving surfaces z1'-z3', for example by a lever to apply a force Fz labelled 'Latch' to act predominantly long the z-direction, is countered by counter forces provided by the receiving datums to surfaces on the printhead shown by arrows A1, A2, A3. Counter forces to the forces applied to they and z surfaces, to be described, are shown with Band C arrows respectively.

Figure 4A:
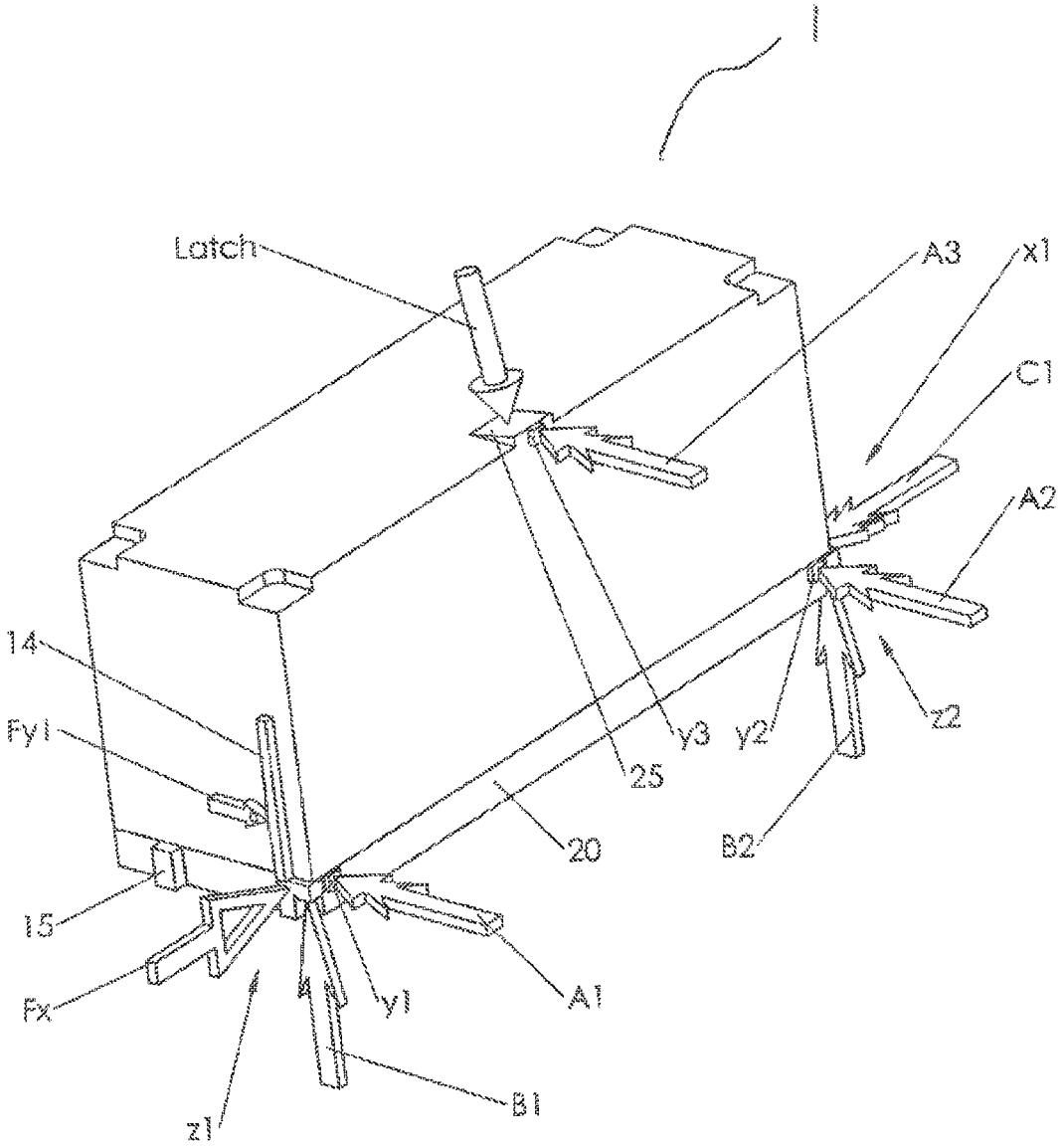
FIG. 4A shows a cuboid-shaped printhead in accordance with the disclosed embodiments, with the reference points and directions of force required indicated for single-pass mode.
Figure 4B:
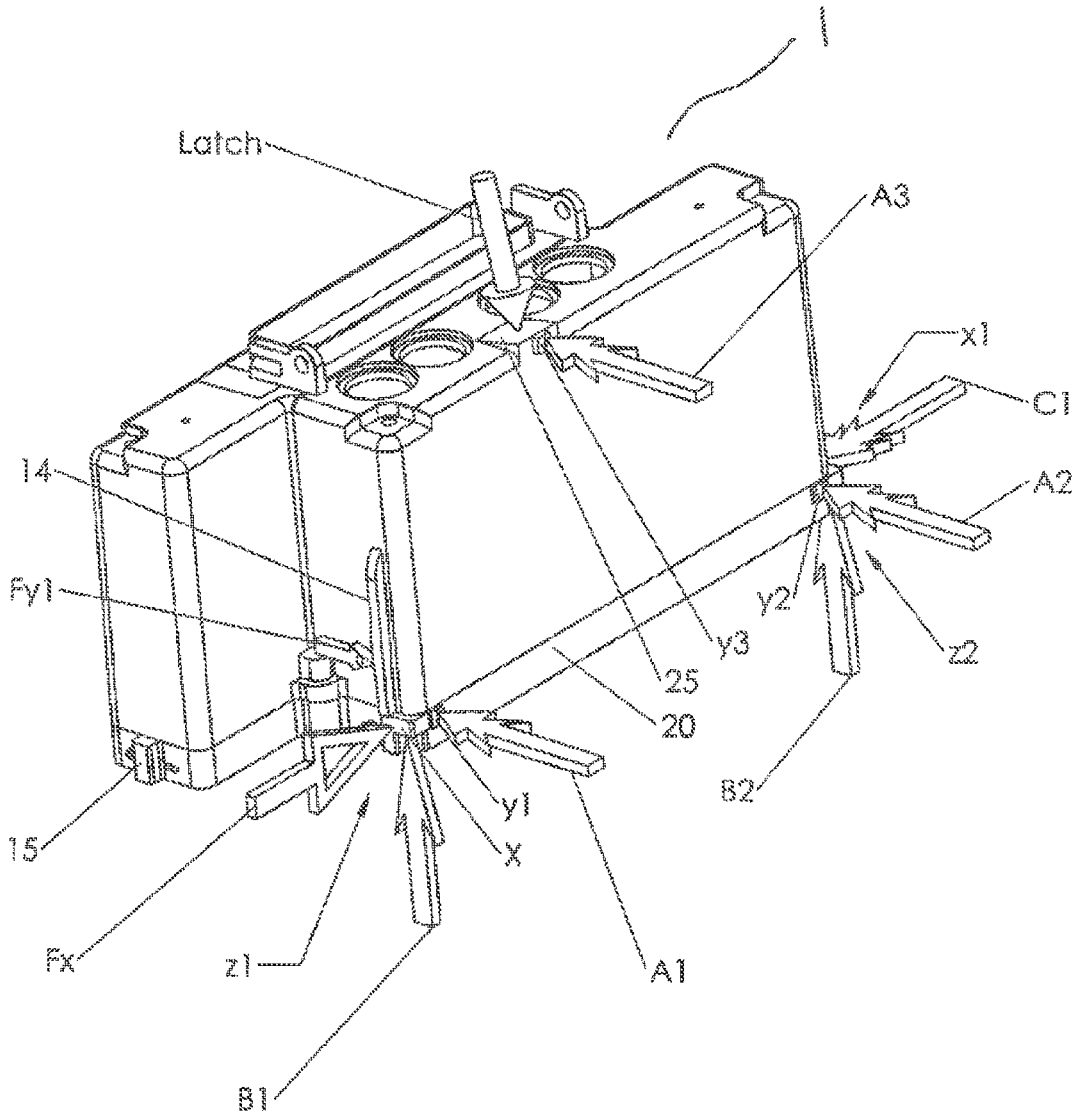
FIG. 4B shows a complex-shaped printhead in accordance with the disclosed embodiments, with the reference points and directions of force required indicated for single-pass mode.

FIG. 4*a* illustrates the alignment surfaces for a cuboid printhead for mounting in a single-pass-mode arrangement, e.g. on a vertical mounting plate as shown in FIG. 1. FIG. 4*b* similarly shows the same indications for the complex cuboid shaped printhead.

Here the primary plane A, rather than being the x-y plane of the base, is the z-x plane defined by three datums located on the rear face of the printhead: two datum surfaces y1, y2 on the rear-facing part of the base 20, which are the same datum surfaces reused from the datum set in the scanning application, and an additional datum surface y3. Datum surface y3 is located near the top rear edge of the printhead, preferably in or near the middle region as shown. This datum surface y3 is most practically located on the printhead cover, which is typically a separate component to the base, and may be integral to the cover, for example when manufactured by a moulding process. If the cover is made from a material that cannot be sufficiently accurately manufactured to form an accurately predefined datum surface, this may be compensated for in the apparatus, for example electronically. For low resolution a mechanical alignment could be envisaged.

With the primary plane A defined by y1-3, the printhead is constrained to move in this plane, and two datum surfaces z1, z2 then define the secondary, or x-y, plane perpendicular to the primary plane. The intersection of the two planes represents the x-axis. Finally, a tertiary datum plane perpendicular to both primary and secondary planes is defined by a single datum surface x1, as shown before. In the printbar configuration therefore, the y3 datum surface is used instead of the z3 datum surface to define the primary plane A.

It will be seen that, of the six datum surfaces necessary to fix the location and orientation of the printhead, five are shared between the two modes, namely y1, y2, z1, z2 and x1. For the scanning mode (FIG. 3) the further surface z3 completes the set, and for the single-pass mode (FIG. 4*b*) it is surface y3. The printhead 1 is therefore very versatile, saving manufacturing costs.

The arrows A1, A2, A3; B2, B3; CI indicate the direction of the counter forces required to act against the forces that urge datums of the printhead securely into position. The 'latch' force provides the force required to urge all three datums that define the primary plane against the datum-receiving surfaces on the mounting parts. In the case of the plate for the scanning mode this is a simple downward force applied to a horizontal part near or on the top of the printhead; in the case of the printbar it is a predominantly downward force with a small y-component to urge the printhead backwards against the vertical surface of the vertical mounting plate. This may be achieved by applying a force "latch" perpendicularly towards a slightly sloped surface 25 as shown in FIG. 4. Forces that are required to be applied in the x- and y-directions are indicated by arrows Fx, Fy1 as shown in FIG. 3 and FIG. 4.

The receiving surfaces z1', z2', y1'-y3' and x1' for the vertical mounting plate mode are different to those described in the scanning mode in the examples, and are explained in more detail as follows.

In the vertical mounting plate mode, force Fy1 may conveniently be applied against a vertical, preferably elongate, rib 14 as indicated on the side of the printhead in FIG. 4. The rib may continue all the way down the base 20; however, this is not strictly necessary. Generally speaking, there will be a similar rib 14 and force Fy2 on the other side (end) of the printhead, the ribs 14 are not seen in FIG. 4 but visible in the two printheads mounted alongside one another in FIG. 7*b*. The location on the rib against which the force Fy acts can be important since it may introduce an increasing rotational moment about the x-axis the higher up it is applied from the location of the z1, z2 datums (here located in the base 20) and thus introduce a force on datum y3.

The ribs may be an integral feature of the printhead.

Figure 5A:
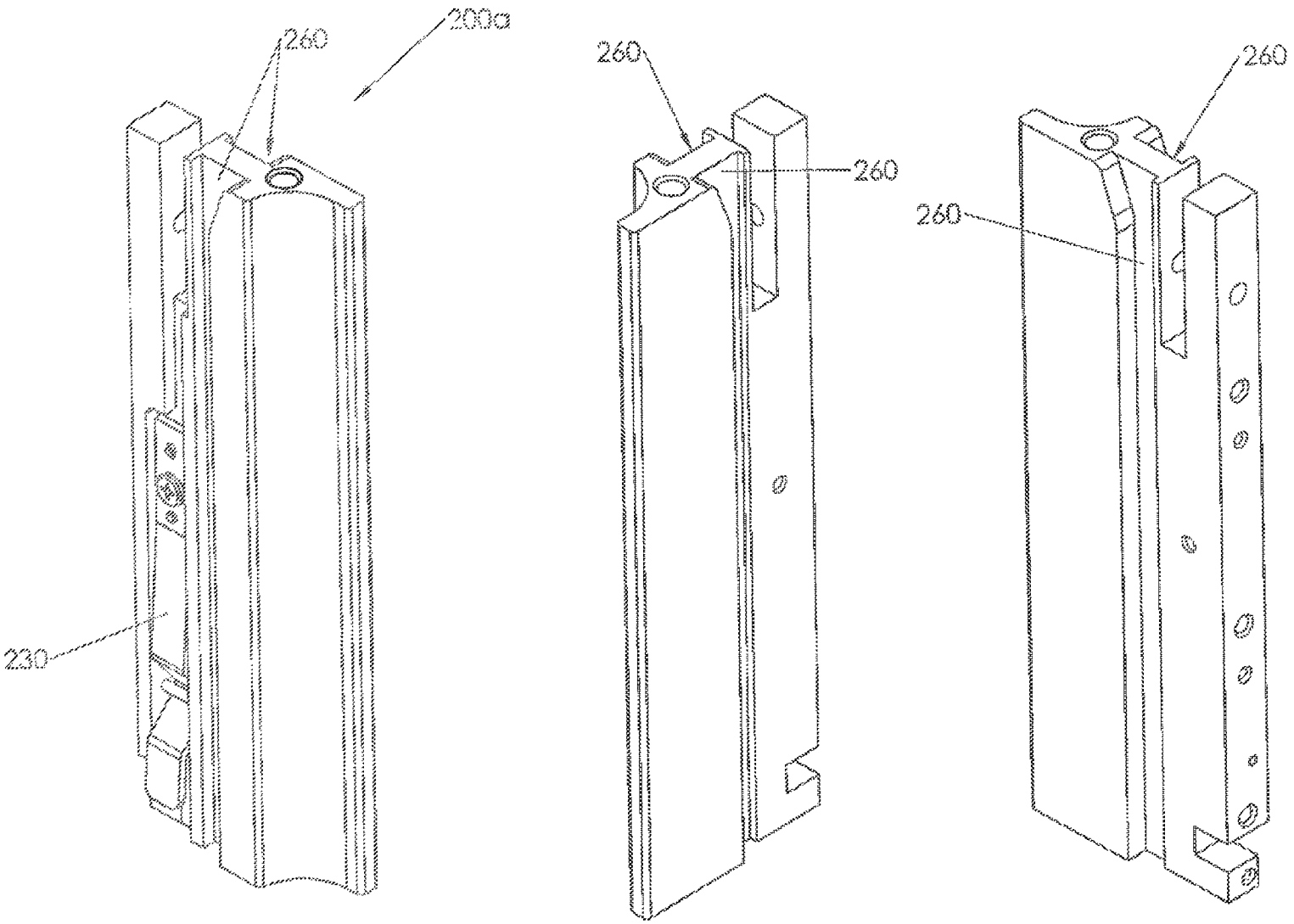
FIG. 5A shows example dividers Part A in accordance with the disclosed embodiments for the scanning mode.
Figure 5B:
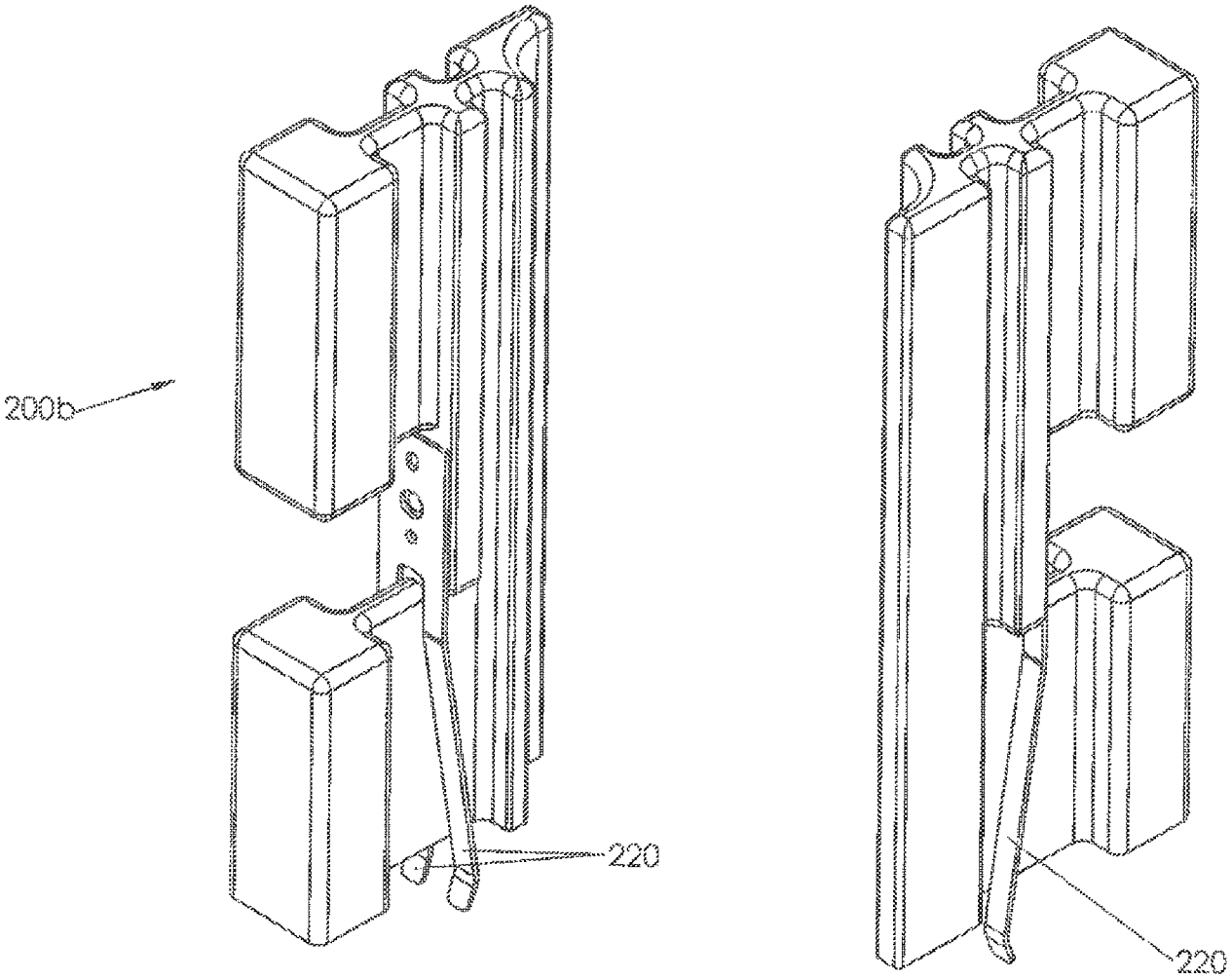
FIG. 5B shows example dividers Part B in accordance with the disclosed embodiments for the scanning mode.

All forces F acting on the datum surfaces may be provided by components of the mounting arrangement. Thus the mount for the printhead has to provide two functions: it has to provide datum-receiving surfaces to match or receive the datum surfaces on the printhead, and it has to provide the mounting forces to urge the printhead into a secure position against the datum-receiving surfaces. Examples of divider structures 200 designed to fulfil most of these functions are shown in FIGS. 5 to 7.

Figure 6:
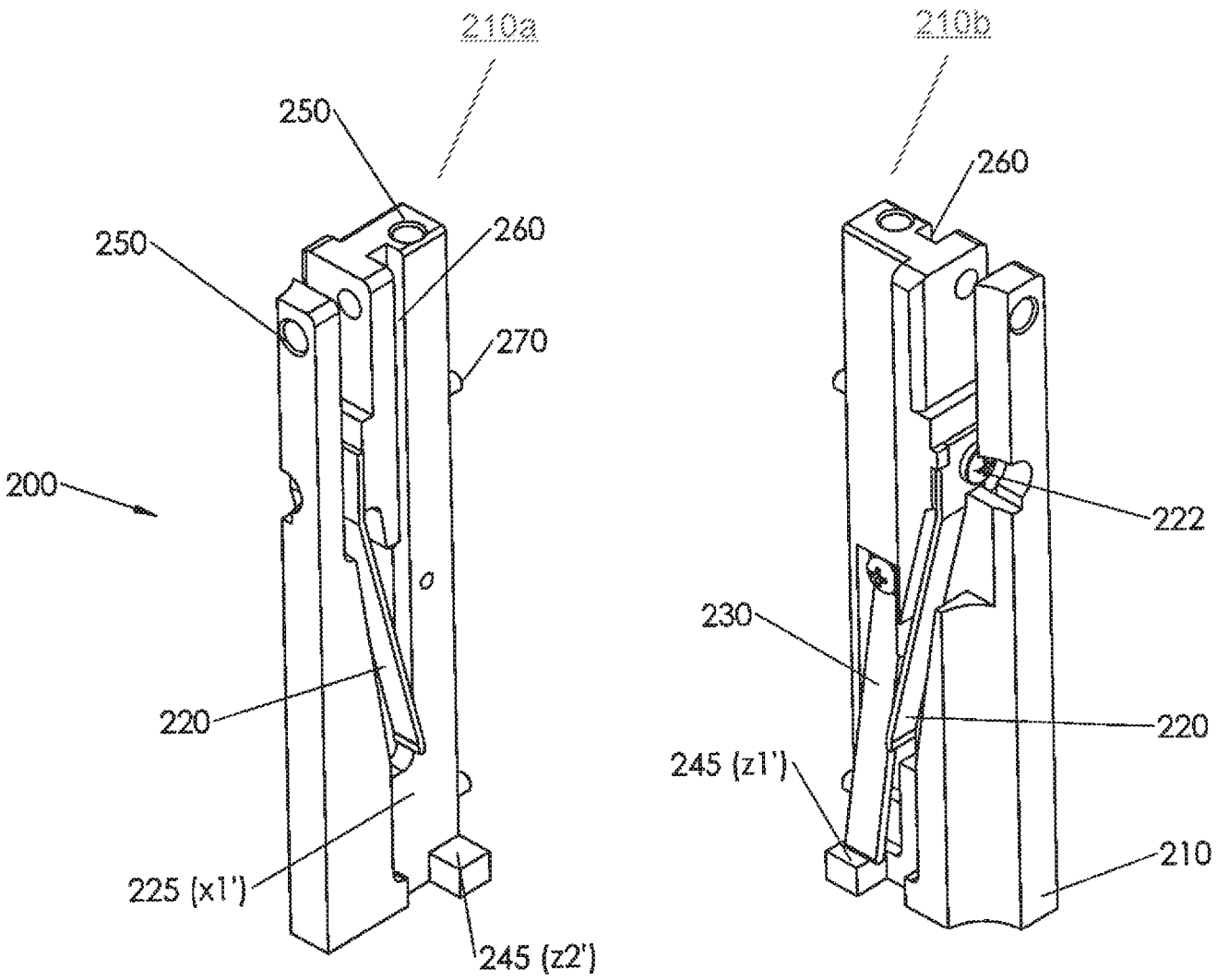
FIG. 6 shows example of dividers in accordance with the disclosed embodiments for the single-pass mode.

FIG. 6, being simpler, will be described first. This shows a divider intended for the vertical mounting plate, or single-pass, system. Two views are given of the example divider from different directions, so that all its features can be seen. The divider in FIG. 6 is of a generally columnar shape, preferably of a height somewhat more than that of the printhead, to allow fitting of a clamping lever, as described later (see also FIG. 1). In the y-direction (depth direction of the printhead) it should be at most as deep as the printhead, or at least not significantly deeper than the printhead, so as to allow close back-to-back mounting of vertical mounting plates, while being able to accommodate resilient means such as springs to urge the printhead's x, y datum surfaces against the receiving surfaces x' and y' of the mounting component, such as the mounting plate. In order to provide force Fy1, the divider needs to further accommodate a slot 260 for receiving the rib 14 located at the side of the printhead. Similarly, the divider should extend as little as possible in the x-direction, in order to allow close mounting of printheads side-by-side while allowing space for the required resilient and receiving features it needs to provide. The divider for the vertical mounting plate further needs to provide a datum-receiving surface for the x-datum of the printhead and a datum-receiving surface for the z1 and z2 datums.

In the z-direction the divider should preferably not extend beyond, or not far beyond, the height of the printhead, so as not to interfere with printhead placement and connections.

The example divider shown may be used one on each side of each printhead, and advantageously comprises force-applying means for adjacent printheads in the same part. This keeps the x-dimension of the divider to a minimum, although a two-part system can be an alternative.

In the case of the divider shown in FIG. 6, the force-applying means comprises leaf springs acting in two orthogonal directions and incorporated within the same part, one acting along the x-direction and the other acting along they-direction of the printhead. In this embodiment these means are shown as leaf springs 220, 230 fixed to the divider by screws 222, 232, but other kinds of spring and other force-applying means are conceivable. Leaf springs have the advantage of compactness in the relevant direction. They could also be integral with the divider to form a single component, for example manufactured as one plastic part.

The springs are shown angled outwards towards the direction in which they are intended to apply a force once engaged, but this is merely a design option.

For the design shown in FIG. 6 where the same part is placed between printheads, two y-springs 220 are required per printhead, one each to act in the direction of the datum surfaces y1 and y2. The divider component therefore comprises a double leaf spring, one to act against the rib of one printhead, and the other to act on the rib of its adjacent neighbour. In this way, an identical divider part can be used to provide the force Fy against the two ribs on each printhead. In FIG. 6, they-spring component 220 is the shape of an inverted 'Y' and one leg extends down the other side, not visible in the drawing. They-springs begin to act against the ribs 14 as the printhead is slotted in between two dividers, the ribs 14 being received by the slots 260 in the dividers. The slots have an opening further down to allow the y-springs 220 to protrude into the slot 260, thus providing a force against the rib 14 as it slides into position in slot 260 and past the spring. The force of they-springs against the ribs urges the printhead datums y1 and y2 against the receiving surfaces y1', y2' on the vertical mounting plate (not visible in FIG. 1). The location in the z-direction at which they-springs act fully against the ribs 14 may be important, to ensure full engagement of datums y1, y2 with their receiving surfaces, while only partially engaging datum y3, if at all.

The x-spring 230 is designed to provide force Fx towards the surface x1 as shown in FIG. 4*b*. This urges the printhead along the x-direction until its datum surface x1 engages with a receiving surface x1', which in this divider design is shown as on a surface 225 located on the side of the divider. The spring 220, providing a force Fy, acts on the inwardly facing side of the rib 14. They-spring 220 is in this example a double spring, in the form of an inverted "Y", with one leg passing down the divider on one side and the other on the other side, to act on adjacent printheads respectively. This specific arrangement results in a compact component.

In the embodiment of FIG. 6, they-spring acts first, being fitted higher in the divider 200. However, the order in which the springs act is shown by way of example only. Depending on friction forces during engagement of the head with the dividers, it may be beneficial to arrange the order so that, for instance, the smaller forces engage first, and the larger forces engage second. In this example, a y-spring is required at each side of the head, acting against each rib 14. Since there are two y-springs and only one x-spring, it may be more beneficial to allow the single x-spring to engage first and the two y-springs to engage second as the printhead is slotted down between the dividers.

FIG. 6 also shows locating pins 270 in the rear surface of the divider, designed to engage precisely into corresponding bores in the vertical mounting plate 100. The divider is then fastened, for instance by screws, though these are not visible. Such locating pins ease the assembly of the dividers to the vertical mounting plate.

As the printhead is slotted down into slots 260, the springs are fully engaged and the printhead in position once its z1 and z2 datums meet corresponding datum-receiving surfaces z1' and z2' located on opposite sides of the divider part, indicated by surfaces 245 on protruding feet of the divider shown in FIG. 6.

Next, an example of an embodiment of dividers designed to work well within the horizontal mounting component will be explained and is shown in FIG. 5 and FIG. 7. In this embodiment, like components are labelled as for FIG. 6. The dividers shown in FIG. 5 are illustrated as a two-part component, a rear Part A (200*a*) shown in detail in Figure Sa having the x-spring 230 and a guide or slot 260 for receiving the rib 14 located in the rear part 12*b* of the printhead (but not having resilient means in they-direction), and a second, front, Part B (200*b*) shown in detail in FIG. Sb comprising the y-springs 220 acting against a protrusion 15 in the base 20 in the front cuboidal part 12*f* of the printhead in FIG. 3*b*. Once the printhead has been fully slotted into place, they-spring is engaged with they-spring abutment surface, in this case the protrusion 15 in the base, and urges the printhead towards the y1, y2 datum-receiving surface 290 on the mounting plate 100. In the case of the horizontal mounting plate, they-spring is required to act as close to, and ideally at, the level of the base where the datum-receiving surfaces are located, in order to avoid rotational components introduced by the Fy forces.

Each forward Part B (200*b*) preferably comprises force-applying means for neighbouring printheads for a compact design, as before. Meanwhile each Part A (200*a*) has one spring 230 acting on one printhead, also as before. In this design, the x-spring 230 is located on part A slightly higher up than the y-spring 220 on part B, so that it engages and applies force to the printhead ahead of they-springs. They-springs are located further down from the x-spring in the z-direction in their respective component Part B, and engage with the protrusion 15 in the base 20 of the printhead once the x-spring is engaged.

Figure 7A:
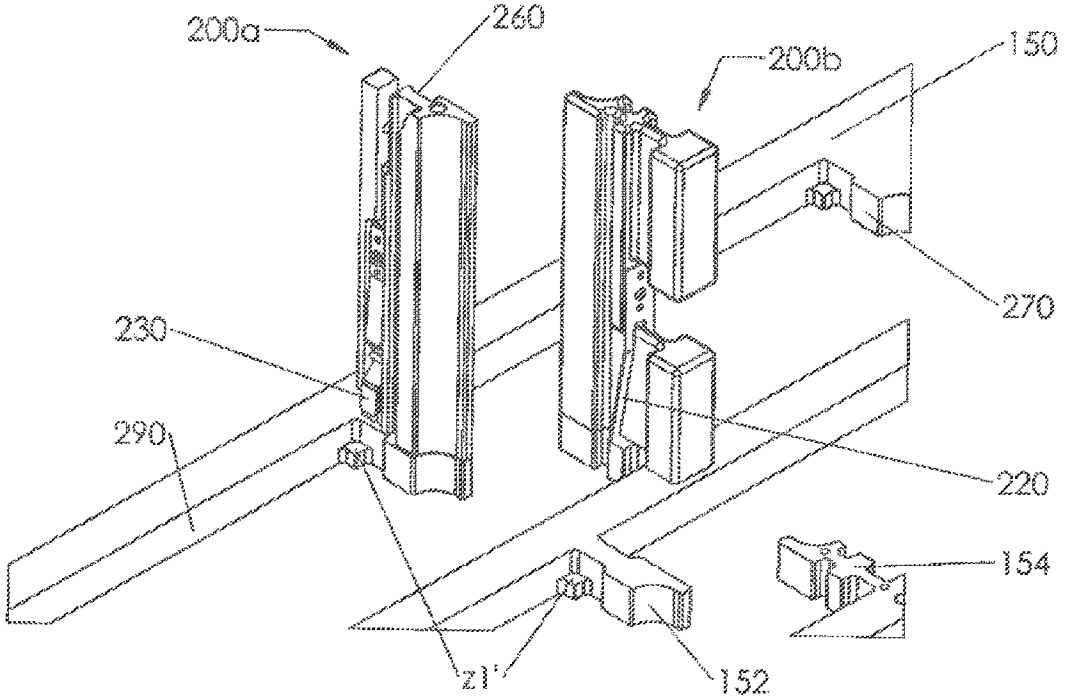
FIG. 7A shows the example dividers of FIG. 5B mounted on a horizontal mounting plate without printheads fitted
Figure 7B:
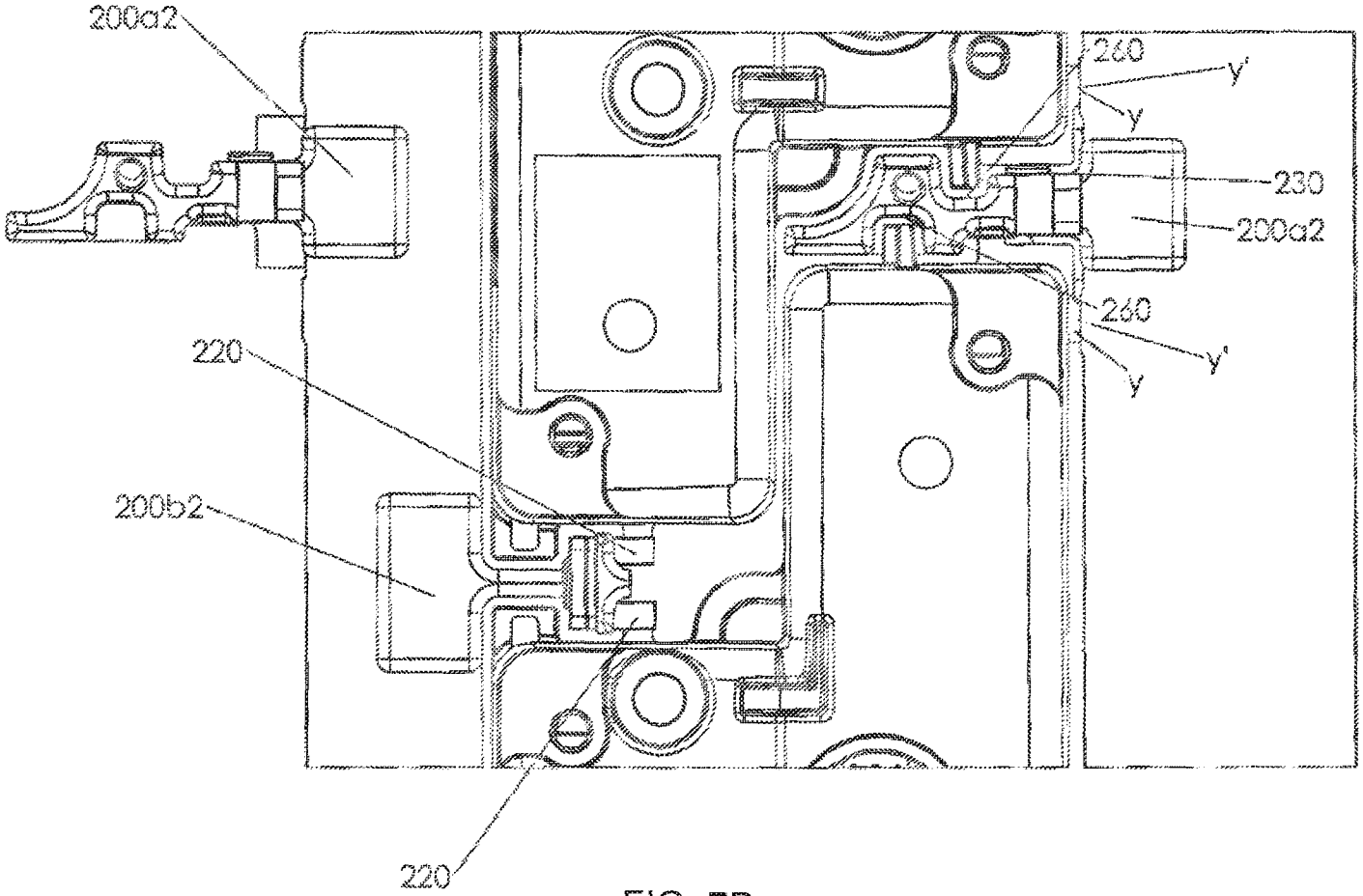
FIG. 7B shows the example dividers of FIG. 5B mounted on a horizontal mounting plate as a plan view with printhead fitted.

FIG. 7 shows details of (a) the mounting plate 150 of FIG. 2*c*, with the pair of divider components 200*a, b* fitted, and (b) a plan view of a printhead fitted between similar divider components 200*a*2 and 200*b*2. It will be seen that part A, or 200*a*, fits on one side of the aperture for the printhead and in this design shown provides the x-spring 230 that acts against the x-datum. Part B, or 200*b*, is at the other side of the aperture and provides the y-spring force. Two parts are required in the design at either end of the printhead to act against the equivalent of ribs 14, as in the vertical mounting plate case. For the horizontal mounting plate however, they-springs 220 preferably act at a low point on the base, in this case the protrusion 15 at either side of the printhead base. As may be seen in FIG. 7*a*, the dividers are supported on protrusions 152, 154 of the plate 150. The plan view of FIG. 7*b* shows how the ribs 14 may be used to guide the printhead between neighbouring parts 200*a*2 by slotting the rib 14 into the slot 260. The protrusions 15 on the printhead are acted against by springs 220 to push datum surfaces y against datum-receiving surfaces y' (in this representation the spring is shaped so that it overlaps the protrusion 15 in plan view and the actual contact line cannot be seen). The x-spring 230 acts against the printhead to push datum surface x against datum-receiving surface x'.

While Part A and Part Bare shown as separate parts, a different design might incorporate their functions in one part. For a compact cuboid shaped printhead, Part A and Part B may more easily be formed as the same part (as for the vertical mounting plate case). For a complex shaped head, Parts A and B may be connected similarly if the head is sufficiently deep in they-direction to allow placement of all necessary features within the same divider part; however if not, and a two-part divider is needed, connection may need to be made across two back-to-back rows of printheads, for example by connecting the two parts 200*b*2 on the left hand edge of FIG. 7*b* and part 200*a*2 by a connecting part along the mounting plate.

The dividers 200*a*, 200*b* are fixed to the horizontal mounting plate for example by countersunk screws from below, not shown in the drawings.

Figure 8:
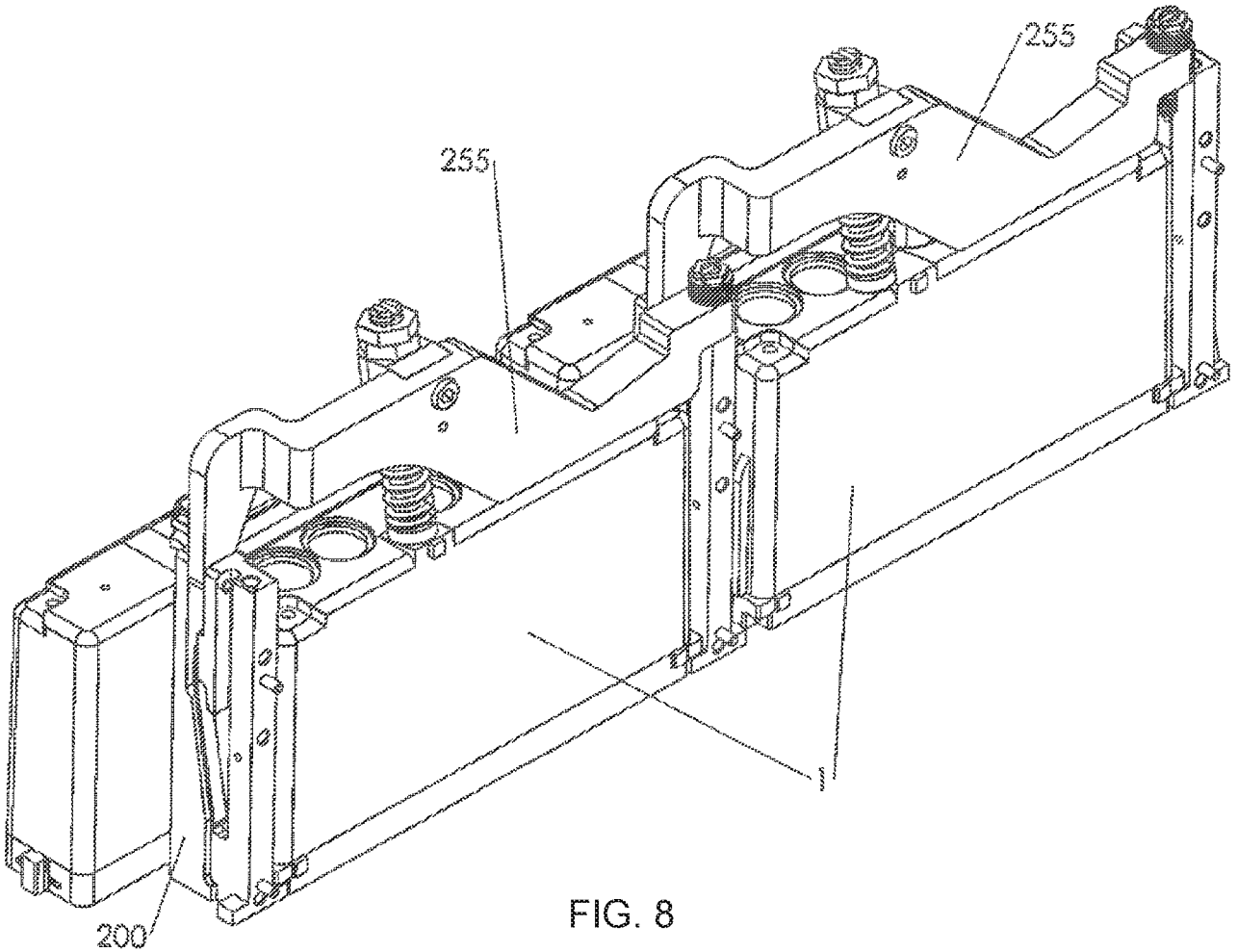
FIG. 8 shows a possible way of clamping the printheads.

In the z-direction, the printhead will generally be held down in all cases by some form of clamp. Such a clamp could be mounted on the vertical mounting plate, but in particular for the scanning mode it is generally convenient to mount it on the upper parts of the two dividers between which the printhead is mounted. To this end the dividers may have holes 250 to allow a clamp 255 to be screwed on or otherwise fastened, as shown in FIG. 8. The clamping in the z-direction needs to be slightly different for the two configurations: for clamping to a plate, the force should be vertical and acting against the primary plane datums z1, z2, z3; for clamping to a vertical mounting plate, a small y-component to the force is required to push down in the z-direction while also urging the datum surface y3 against the receiving surface on the vertical mounting plate. This can be ensured by directing the generally vertical clamping force onto a ramp-shaped elevation 25 (FIG. 4) on the top surface of the printhead. In the embodiment shown, this ramp may also conveniently incorporate the datum or land y3, as can be seen in FIG. 4.

To assemble a printer, dividers 200 are fitted to a plate 150 or bar 100, and printheads 1 are inserted between pairs of dividers until the z-alignment surfaces are in contact (three with the plate in the case of the scanning mode, two with the vertical mounting plate in the single-pass mode). During this placement, the x- and y-springs 230, 220 arranged within the dividers engage and urge the lower rear edge of the printhead against the vertical mounting plate or the plate, and towards the x1 datum-receiving surface on the neighbouring divider in the x-direction. The printheads are then clamped securely in place and the necessary connections, e.g. electric and fluidic, can be made.

The divider may in theory advantageously be designed to be usable in both the single-pass and the scanning-mode configurations. However, this is not necessary: different dividers could be used in the two modes, as in FIGS. 5 and 6, though the general principle of exerting forces would be the same. Preferably the clamping lever 255 does not interfere with the subsequent connections.

According to a first aspect of the disclosed embodiments, there is provided a droplet deposition head (1) comprising one or more actuator components (2), an actuator component including nozzles arranged for ejecting fluid, the head including a datum surface arrangement for alignment of the head relative to an external mounting component (100; 150) in either a vertical mounting mode in which the head is held against a vertical mounting plate or a horizontal mounting mode where the head is held against a horizontal mounting plate; the datum surface arrangement comprising at least seven datum surfaces (x1; y1, y2, y3; z1, z2, z3) provided on the head, wherein five of the seven datum surfaces are provided for alignment in both vertical and horizontal mounting modes, and wherein a sixth datum surface (z3) is provided for alignment exclusively in said horizontal mounting mode and a seventh datum surface (y3) is provided for alignment exclusively in said vertical mounting mode.

In embodiments, the datum surfaces define three datum planes (A, B, C), wherein a first primary datum plane comprises three of the datum surfaces, a second datum plane perpendicular to the first datum plane is then defined by two datum surfaces and a third datum plane perpendicular to the first and second datum planes is then defined by the remaining datum surface.

In embodiments, the datum surfaces define three datum planes (A, B, C), wherein a first primary datum plane comprises three of the datum surfaces, and two further datum surfaces define the intersection of the first plane with a second datum plane along said intersection.

In further embodiments, the primary plane defined by first three of the datums (y1, y2, y3) for the vertical mounting plate is different from the primary plane for the horizontal mounting plate defined by another three datums (z1, z2, z3) distinct from the first three datums.

In embodiments, said actuator components (2) are arranged on one surface of a base (20), and at least one, preferably at least six, of the datum surfaces are located on or near corners of the base bounding said face.

In embodiments, a primary plane defined by the z-datums z1, z2, z3 is parallel to the line or plane defined by the nozzles of the actuator component (2).

In embodiments, at least some of the datum surfaces are in the form of small raised lands on the surface of the head, of linear dimensions less than 5% those of the head.

In embodiments, at least some of the datum surfaces are in the form of small defined domed surfaces enabling the alignment of the printhead.

In the further embodiments, there is provided a memory capable of storing data used to compensate for misalignment of the two remaining datum surfaces relating respectively to the horizontal and vertical mounting modes.

In any of the embodiments, the droplet deposition head may be constituted as a printhead.

According to a second aspect of the disclosed embodiments, there is provided a divider system (200; 200 *a*, 200 *b*) for securing a droplet deposition head to a mounting plate (100; 150) external to the droplet deposition head, the divider system including at least one main body (210*a*, 210*b*) to be fixed to the mounting plate, and at least two biasing means (220, 230) arranged on the or each main body (210*a*, 210*b*) of the divider system, so as to provide a force on the droplet deposition head along two axes (x, y) to urge said head into alignment with corresponding datum receiving surfaces located on at least one of the mounting plate or the divider system.

In embodiments of the divider system the biasing means that act on the two axes (x, y) of the printhead are arranged at different heights, as seen along a third axis (z) on the body of the divider, such that a first biasing means component acting along one of the two axes engages fully before a second biasing means component.

In embodiments, at least one of said datum-receiving surfaces (225; 245) are configured to come in contact with a datum surface on a droplet deposition head aligned on a vertical mounting plate (100).

In embodiments, the datum-receiving surface or surfaces (225; 245) includes a surface (xi') for aligning the x-datum on the printhead and/or one or more datum-receiving surfaces z2' (245) configured to align the one or more z-datum surfaces on the droplet deposition head.

In embodiments, the divider system is constructed in two parts (200*a*, 200*b*), one part having the biasing means for one of the said two axes (x, y) and the other part having the biasing means for the other of the said two axes.

In embodiments, the divider system further includes a pivoting arm (255) configured to be fastened to another such divider so as to exert a clamping force on the droplet deposition head located between the two dividers in the direction of the third axis (z).

In embodiments, the droplet deposition apparatus includes a droplet deposition head held between two divider systems (200).

In embodiments, the dividers are fixed to or incorporated into a horizontal mounting plate (150) or a vertical mounting plate (100), the divider systems each being configured to exert a biasing force on the droplet deposition head along two axes (x, y).

In embodiments, there are several such droplet deposition heads (1), preferably in the form of printheads, adjacent heads being held in place by sharing a divider system (200).

According to a third aspect of the disclosed embodiments, there is provided a method of mounting a printhead on an external mounting component, said printhead having a plurality of datum surfaces (x1, x2, . . . ) for aligning said head on at least two different types of external mounting component (100; 150), wherein some, but not all, of the datum surfaces of the printhead are aligned with respect to one or more datum-receiving surfaces when mounting said head on a first type of external mounting component; and wherein at least one of the remaining datum surfaces (y3; z3) on the printhead is aligned with respect one or more datum-receiving surfaces (y3'; z3') when mounting said head on a second type of mounting component (150; 100).

In embodiments, said first type of mounting component comprises a horizontal plate (100) and said second type of mounting component comprises a vertical plate (150).

According to a fourth aspect of the disclosed embodiments, there is provided a method of alignment of a printhead, in which a printhead base (20) comprises three datum surfaces z1, z2, z3 defining the x-y plane of the printhead, two further datum surfaces y1, y2 defining the rear z-x surface of the printhead perpendicular to the x-y plane, and a datum surface x1 defining the location of the z-y plane of the printhead with respect to a mounting plate (150), said z-y plane being perpendicular to the x-y and z-x planes, wherein said printhead base is mounted during printhead assembly on the horizontal mounting plate (150), the horizontal mounting plate having six datum-receiving surfaces (z1', z2', z3', y1', y2' and x1'), one or more actuator components (2) are mounted on the base (20) and their alignment is fixed with reference to at least three of the datum-receiving surfaces of the mounting plate, and said base (20) is fitted with a cover (12) comprising a seventh datum surface (y3) located near the top rear of the printhead, and after assembly the printhead is installed in a printer using a printer mounting system having six datum-receiving surfaces that receive six of the seven datums located on the printhead.

According to a fifth aspect of the disclosed embodiments, there is provided a droplet deposition head (1) comprising one or more actuator components (2), an actuator component including nozzles arranged for ejecting fluid, the head having a plurality of datum surfaces (x1, x2, . . . ) for aligning said head on at least two different types of external mounting component (100; 150), wherein some, but not all, of the datum surfaces of the printhead are arranged for aligning said head against one or more datum-receiving surfaces of a first type of external mounting component; and wherein at least one of the remaining datum surfaces (y3; z3) on the printhead is arranged for aligning said head against one or more datum-receiving surfaces (y3'; z3') of a second type of mounting component (150; 100).

In embodiments, of the seven datum surfaces wherein five of said datum surfaces are arranged for aligning said head against both of said first and said second type of mounting component, and wherein a sixth datum surface is arranged for aligning exclusively against said first type of mounting component and a seventh datum surface for aligning exclusively against said second type of mounting component.

In embodiments, the datum surfaces define three datum planes (A, B, C), wherein a first primary datum plane comprises three of the datum surfaces, and two further datum surfaces define the intersection of the first plane with a second datum plane, and a sixth datum surface defines the location of the first datum plane along said intersection.

In embodiments, said actuator components (2) are arranged on one side of a face of a base (20), and at least one, preferably at least six, of the datum surfaces are located on or near corners of the base bounding said face.

In embodiments, a primary plane defined by the z-datums z1, z2, z3 is parallel to the line or plane defined by the nozzles of the actuator component (2).

In embodiments, the datum planes are perpendicular to one another.

In embodiments, the primary plane defined by first three of the datums (y1, y2, y3) for a vertical mounting plate is different from the primary plane for a horizontal mounting plate defined by another three datums (z1, z2, z3) and distinct from the first three datums.

It will be understood that any reference to datum "point" does not impose the strict meaning of "point" to the shape of the intended datum. It is merely a reflection of the relative size of the datum surface with respect to the surface area of the printhead. Any datum surface may be used as long as it fulfils its intended purpose, and may be planar, domed, curvilinear, pyramidal, or a combination of shapes, or may be just a specified raised part of an existing structure. Similarly, the datum surface may be indented while their corresponding receiving surfaces are suitably raised.

It should be noted that a mounting plate might equally be used for a single-pass, or static, arrangement instead of the vertical mounting plate.

It will be understood that whilst various concepts are described above with reference to an inkjet printhead, such concepts are not limited to inkjet printheads, but may be applied more broadly in printheads, or more broadly still in droplet deposition heads, for any suitable application. As noted above, droplet deposition heads suitable for such alternative applications may be generally similar in construction to printheads, with some adaptations made to handle the specific fluid in question. The preceding description should therefore be understood as providing non-limiting examples of applications in which such a droplet deposition head may be used.

The invention claimed is:

1. A divider system for securing a droplet deposition head to a mounting plate external to the droplet deposition head, the divider system comprising at least one main body to be fixed to the mounting plate, and at least two biasing means arranged on the at least one main body, wherein the droplet deposition head comprises three or more datum surfaces, the mounting plate comprises at least one of a horizontal mounting plate or a vertical mounting plate, three or more datum-receiving surfaces are located on at least one of the mounting plate or the at least one main body; and the at least two biasing means provide a force along two axes of the droplet deposition head to urge three or more datum surfaces of the droplet deposition head into alignment with corresponding three or more datum-receiving surfaces of at least one of the mounting plate or the at least one main body, wherein the at least two biasing means comprise a double action biasing means.

2. A divider system according to claim 1, wherein:

the at least two biasing means comprise a first biasing means and a second biasing means; and the first biasing means and the second biasing means are arranged at different heights along a third axis of the at least one main body, the third axis being different from the two axes of the droplet deposition head, such that the first biasing means engages fully before the second biasing means engages.

3. A divider system according to claim 2, wherein:

a datum-receiving surface from the three or more datum-receiving surfaces is configured to come in contact with a datum surface of the three or more datum surfaces on the droplet deposition head aligned on the horizontal mounting plate.

4. A divider system according to claim 2, wherein:

the divider system comprises a rear part and a forward part, the rear part comprises biasing means of the at least two biasing means for a first axis of the two axes; and the forward part comprises biasing means of the at least two biasing means for a second axis of the two axes.

5. A divider system according to claim 1, wherein:

a datum-receiving surface from the three or more datum-receiving surfaces is configured to come in contact with a datum surface of the three or more datum surfaces on the droplet deposition head aligned on the vertical mounting plate.

6. A divider system according to claim 5, wherein the datum-receiving surfaces comprise:

a first receiving surface for aligning an x-datum surface on the droplet deposition head; and a second receiving surface for aligning a z-datum surface on the droplet deposition head.

7. A divider system according to claim 1, wherein:

the divider system comprises a rear part and a forward part, the rear part comprises biasing means of the at least two biasing means for a first axis of the two axes; and the forward part comprises biasing means of the at least two biasing means for a second axis of the two axes.

8. A divider system according to claim 1, further comprising a pivoting arm configured to be fastened to another divider system and exert a clamping force on the droplet deposition head when the droplet deposition head is located between the divider system and the another divider system in a direction of a third axis.

9. A droplet deposition apparatus comprising:

a droplet deposition head;

a mounting plate; and a divider system, wherein:

the droplet deposition head comprises three or more datum surfaces, the mounting plate comprises at least one of a horizontal mounting plate or a vertical mounting plate, at least one of the mounting plate and the divider system comprising datum-receiving surfaces, the divider system comprises:

a main body to be fixed to the mounting plate, and at least two biasing means arranged on the main body, and the at least two biasing means provide a force along two axes of the droplet deposition head to urge three or more datum surfaces of the droplet deposition head into alignment with corresponding datum-receiving surfaces of at least one of the mounting plate or the main body, and the droplet deposition apparatus further comprises a pivoting arm configured to be fastened to another divider system and exert a clamping force on the droplet deposition head when the droplet deposition head is located between the divider system and the another divider system in a direction of a third axis.

10. A droplet deposition apparatus according to claim 9, further comprising:

a plurality of droplet deposition heads, and wherein adjacent droplet deposition heads of the plurality of droplet deposition heads are held in place by sharing the divider system.

11. A droplet deposition apparatus according to claim 10, wherein the at least two biasing means comprises a double spring to act on the adjacent droplet deposition heads.

12. A droplet deposition apparatus according to claim 9, wherein the droplet deposition apparatus is an inkjet printer.

13. An apparatus for securing at least one droplet deposition head, the droplet deposition head comprising three or more datum surfaces, the apparatus comprising:

a mounting plate comprising: at least one of a horizontal mounting plate or a vertical mounting plate;

a divider system comprising:

a main body to be fixed to the mounting plate, and at least two biasing means arranged on the main body;

wherein at least one of the mounting plate and the divider system comprises three or more datum-receiving surfaces, the at least two biasing means provide a force along two axes of the droplet deposition head to urge three or more datum surfaces of the droplet deposition head into alignment with corresponding three or more datum-receiving surfaces of at least one of the mounting plate or the main body, the at least two biasing means comprise a first biasing means and a second biasing means; and the first biasing means and the second biasing means are arranged at different heights along a third axis of the main body, the third axis being different from the two axes of the droplet deposition head, such that the first biasing means engages fully before the second biasing means engages.

14. An apparatus according to claim 13, wherein:

the divider system is constructed in two parts, a first part comprising a biasing means of the at least two biasing means for one of the two axes of the droplet deposition head, and a second part comprising a biasing means of the at least two biasing means for the other of the two axes of the droplet deposition head.

15. An apparatus according to claim 13, further comprising a pivoting arm configured to:

be fastened to another divider system, and exert a clamping force on the droplet deposition head when the droplet deposition head is located between the divider system and the another divider system in a direction of a third axis of the main body, the third axis being different from the two axes of the droplet deposition head.

16. An apparatus according to claim 13, wherein:

a datum-receiving surface from the corresponding three or more datum-receiving surfaces is configured to come in contact with at least one of the three or more datum surfaces that are aligned on the vertical mounting plate.

17. An apparatus according to claim 13, wherein:

a datum-receiving surface from the corresponding three or more datum-receiving surfaces is configured to come in contact with at least one of the three or more datum surfaces that are aligned on the horizontal mounting plate.

* * * * *